US010474049B2

(12) United States Patent
Onozaki et al.

(10) Patent No.: US 10,474,049 B2
(45) Date of Patent: Nov. 12, 2019

(54) TONER

(71) Applicant: CANON KABUSHIKI KAISHA, Tokyo (JP)

(72) Inventors: Yuto Onozaki, Saitama (JP); Masayuki Hama, Toride (JP); Takeshi Hashimoto, Moriya (JP); Ichiro Kanno, Kashiwa (JP); Hitoshi Sano, Tokyo (JP); Akifumi Matsubara, Narashino (JP); Nozomu Komatsu, Toride (JP); Takakuni Kobori, Toride (JP); Hiroyuki Fujikawa, Yokohama (JP); Tsubasa Fujisaki, Toride (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 16/358,919

(22) Filed: Mar. 20, 2019

(65) Prior Publication Data

US 2019/0219939 A1 Jul. 18, 2019

Related U.S. Application Data

(62) Division of application No. 15/498,966, filed on Apr. 27, 2017, now abandoned.

(30) Foreign Application Priority Data

May 2, 2016 (JP) ..... 2016-092528

(51) Int. Cl.
*G03G 9/093* (2006.01)
*G03G 9/08* (2006.01)
(Continued)

(52) U.S. Cl.
CPC ..... *G03G 9/09321* (2013.01); *G03G 9/0819* (2013.01); *G03G 9/0821* (2013.01);
(Continued)

(58) Field of Classification Search
CPC ..... G03G 9/09321; G03G 9/0821; G03G 9/09378; G03G 9/09371; G03G 9/09392;
(Continued)

(56) References Cited

U.S. PATENT DOCUMENTS 5,424,810 A 6/1995 Tomiyama et al.
5,464,722 A 11/1995 Tomiyama et al.
(Continued)

FOREIGN PATENT DOCUMENTS

JP 2000147829 5/2000
JP 2006276074 10/2006
(Continued)

*Primary Examiner* — Thorl Chea
(74) *Attorney, Agent, or Firm* — Venable LLP

(57) ABSTRACT

By controlling the migration to the toner particle surface of the crystalline polyester present in the toner particle, a toner is provided that exhibits an excellent durability in long-term use, a stable charging performance after holding in a high-temperature, high-humidity environment, and an excellent low-temperature fixability, in which the toner having a toner particle that contains an amorphous resin, a crystalline polyester, and a wax, wherein the toner particle includes, at the surface thereof, a coat layer containing a cyclic polyolefin resin.

7 Claims, 2 Drawing Sheets

(51) Int. Cl.
*G03G 9/087* (2006.01)
*G03G 9/09* (2006.01)

(52) U.S. Cl.
CPC ..... *G03G 9/0825* (2013.01); *G03G 9/0827* (2013.01); *G03G 9/08704* (2013.01); *G03G 9/08755* (2013.01); *G03G 9/08797* (2013.01); *G03G 9/0918* (2013.01); *G03G 9/09371* (2013.01); *G03G 9/09378* (2013.01); *G03G 9/09392* (2013.01)

(58) Field of Classification Search
CPC ..... G03G 9/08755; G03G 9/0827; G03G 9/0918; G03G 9/0825; G03G 9/08704; G03G 9/08797; G03G 9/0819
See application file for complete search history.

(56) References Cited

U.S. PATENT DOCUMENTS 5,700,616 A 12/1997 Kasuya et al.
5,712,073 A 1/1998 Katada et al.
5,968,701 A 10/1999 Onuma et al.
5,972,553 A 10/1999 Katada et al.
6,002,895 A 12/1999 Kasuya et al.
6,007,957 A 12/1999 Kobori et al.
6,020,102 A 2/2000 Fujimoto et al.
6,120,961 A 9/2000 Tanikawa et al.
6,156,471 A 12/2000 Kobori et al.
6,203,959 B1 3/2001 Tanikawa et al.
6,235,441 B1 5/2001 Tanikawa et al.
6,430,384 B2 8/2002 Hama et al.
6,653,036 B1 11/2003 Tanikawa et al.
6,670,087 B2 12/2003 Fujikawa et al.
6,751,424 B2 6/2004 Komatsu et al.
6,808,852 B2 10/2004 Hotta et al.
7,112,395 B2 9/2006 Ida et al.
7,135,263 B2 11/2006 Kawakami et al.
7,147,980 B2 12/2006 Itakura et al.
7,147,981 B2 12/2006 Fujikawa et al.
7,229,727 B2 6/2007 Itakura et al.
7,279,262 B2 10/2007 Fujikawa et al.
7,288,348 B2 10/2007 Hayami et al.
7,297,455 B2 11/2007 Fujikawa et al.
7,300,733 B2 11/2007 Sugahara et al.
7,396,626 B2 7/2008 Fujikawa et al.
7,396,629 B2 7/2008 Baba et al.
7,442,478 B2 10/2008 Itakura et al.
7,452,647 B2 11/2008 Hayami et al.
7,611,813 B2 11/2009 Ida et al.
7,855,042 B2 12/2010 Kobori et al.
7,858,283 B2 12/2010 Ishigami et al.
7,875,413 B2 1/2011 Shibai et al.
7,927,775 B2 4/2011 Komatsu et al.
7,939,233 B2 5/2011 Inoue et al.
8,137,886 B2 3/2012 Baba et al.
8,142,972 B2 3/2012 Hotta et al.
8,288,069 B2 10/2012 Fujikawa et al.
8,927,188 B2 1/2015 Naka et al.
8,986,914 B2 3/2015 Fujikawa et al.
9,034,549 B2 5/2015 Shiotari et al.
9,058,924 B2 6/2015 Komatsu et al.
9,063,443 B2 6/2015 Ishigami et al.
9,152,088 B1 10/2015 Kobori et al.
9,348,253 B2 5/2016 Kanno et al.
9,372,420 B2 6/2016 Mizo et al.
9,417,540 B2 8/2016 Hashimoto et al.
9,500,975 B2 11/2016 Sugahara et al.
9,594,323 B2 3/2017 Fujikawa et al.
9,599,920 B2 3/2017 Sugahara et al.
9,665,021 B2 5/2017 Ohtsu et al.
9,665,023 B2 5/2017 Kamae et al.
9,665,026 B2 5/2017 Iwasaki et al.
10,146,146 B2 12/2018 Komatsu et al.
2008/0166156 A1 7/2008 Kawase
2009/0197190 A1 8/2009 Nakamura et al.
2009/0286176 A1 11/2009 Ohmura et al.
2010/0028796 A1 2/2010 Nakamura et al.
2010/0183971 A1 7/2010 Fujikawa et al.
2013/0244159 A1 9/2013 Ishigami et al.
2013/0288173 A1 10/2013 Hashimoto et al.
2014/0045115 A1 2/2014 Baba et al.
2014/0101966 A1 4/2014 Minagawa et al.
2014/0134535 A1 5/2014 Baba et al.
2014/0137428 A1 5/2014 Takenaka et al.
2014/0329176 A1 11/2014 Kanno et al.
2016/0306301 A1 10/2016 Sugahara et al.
2016/0363877 A1 12/2016 Hama et al.
2016/0363878 A1 12/2016 Hama et al.
2016/0363889 A1 12/2016 Onozaki et al.

FOREIGN PATENT DOCUMENTS

JP 2007003840 1/2007
JP 2007298869 11/2007

TONER

BACKGROUND OF THE INVENTION

Field of the Invention

The present invention relates to a toner used in electrophotographic system-based copiers and printers.

Description of the Related Art

In recent years, full-color copiers that use electrophotographic systems have become widespread and have also begun to be used in the printing market. The printing market requires high speeds, high image quality, and high productivities while accommodating a wide range of media (paper types).

For example, a constant media velocity is being demanded, wherein, even while the paper type fluctuates from thick paper to thin paper, printing continues without changing the process speed and/or the heating set temperature at the fixing unit in conformity to the paper type. This constant media velocity requires of the toner that fixing be properly completed in a wide fixation temperature range from low temperatures to high temperatures. In particular, the expansion of the fixation temperature range at low temperature has great merit, e.g., this can achieve a shortening of what is known as the warm-up time—i.e., the waiting time when power is input until the surface of the fixing member, for example, the fixing roll, is up to the temperature at which fixing can be carried out—or can support a lengthening of the service life of the fixing member.

In order to obtain printed material having a high image quality without causing the production of, e.g., offset development during fixing, Japanese Patent Application Laid-open No. 2000-147829 discloses the use of a cycloolefin resin as the binder resin constituting the toner particle.

Cycloolefin resins have a high transparency and are thus suitable for the formation of color images; enable a reduction in toner consumption due to their low specific gravity; and support facile control of the glass transition temperature through selection of the monomer. Thus, cycloolefin resins have various advantages and are useful as binder resins for toners.

In addition, cycloolefin resins have a low hygroscopicity because they do not have polar groups in the molecule and offer the advantage of exhibiting an excellent charging performance; however, a problem is their low adhesiveness to paper. As a result, an image formed by a toner that contains a cycloolefin resin as its binder resin will have a low fixing strength for paper and the gloss will also be low.

In response to this problem and in order to impart a high gloss and obtain a printed material having a high image quality, Japanese Patent Application Laid-open No. 2007-298869 discloses the use of, for example, polyester resin as the binder resin constituting the toner particle.

Japanese Patent Application Laid-open No. 2007-298869 discloses a toner that has a core/shell structure and contains a cycloolefin resin-containing coat layer and a toner particle containing a synthetic resin such as polyester resin.

The surface of this toner is coated by a cycloolefin resin, which has a poor fixing performance for, e.g., paper. However, a high-gloss, high-strength fixed image is realized due to the intermixing of the cycloolefin resin and polyester resin by the application of pressure during fixing of the toner. It is hypothesized that the cause for this is that the compatibility between the cycloolefin resin and the binder resin present in the toner particle is relatively good. However, this toner is unable to exhibit a satisfactory low-temperature fixability and it has also been difficult with this toner to secure a satisfactory fixing temperature range.

On the other hand, the use of a crystalline polyester having a low melt viscosity in order to bring about further improvement in the low-temperature fixability of a toner is known (for example, Japanese Patent Application Laid-open No. 2007-003840 and Japanese Patent Application Laid-open No. 2006-276074).

Japanese Patent Application Laid-open No. 2007-003840 proposes a core/shell structure and discloses a toner that contains a crystalline polyester in the core and an amorphous polyester in the shell.

A high gloss co-exists with low-temperature fixability in the toner proposed in Japanese Patent Application Laid-open No. 2006-276074, which uses a cycloolefin-type copolymer resin for its binder resin and contains a crystalline polyester.

SUMMARY OF THE INVENTION

However, toner that contains crystalline polyester, while due to its properties having a sharp melt property and exhibiting an excellent fixing performance, has on the other hand had the problem of an unsatisfactory durability stability. For example, the crystalline polyester can outmigrate to the toner particle surface under circumstances in which the toner is exposed to a high-temperature, high-humidity environment or is exposed to mechanical stress. Here, mechanical stress is stress due to extended stirring within the developing device or due to friction with the member referred to as the regulating blade. In such a case, the crystalline polyester can melt and attach to a member and thereby produce filming, which can cause a reduction in member service life and can cause image defects. In addition, crystalline polyester has polar groups in its molecule and due to this readily absorbs moisture in a high-humidity environment. The charge quantity fluctuates depending on the state of moisture absorption, and this problem can also occur to a substantial degree when crystalline polyester migrates to the toner particle surface.

The present invention provides a toner that solves these problems.

Specifically, by controlling the migration to the toner particle surface of the crystalline polyester present in the toner particle, a toner is provided that exhibits an excellent durability in long-term use, a stable charging performance after holding in a high-temperature, high-humidity environment, and an excellent low-temperature fixability.

The present invention relates to a toner comprising a toner particle containing an amorphous resin, a crystalline polyester, and a wax, wherein the toner particle comprises a coat layer containing a cyclic polyolefin resin at the surface of the toner particle.

Further features of the present invention will become apparent from the following description of exemplary embodiments with reference to the attached drawings.

DESCRIPTION OF THE EMBODIMENTS

Figure 1:
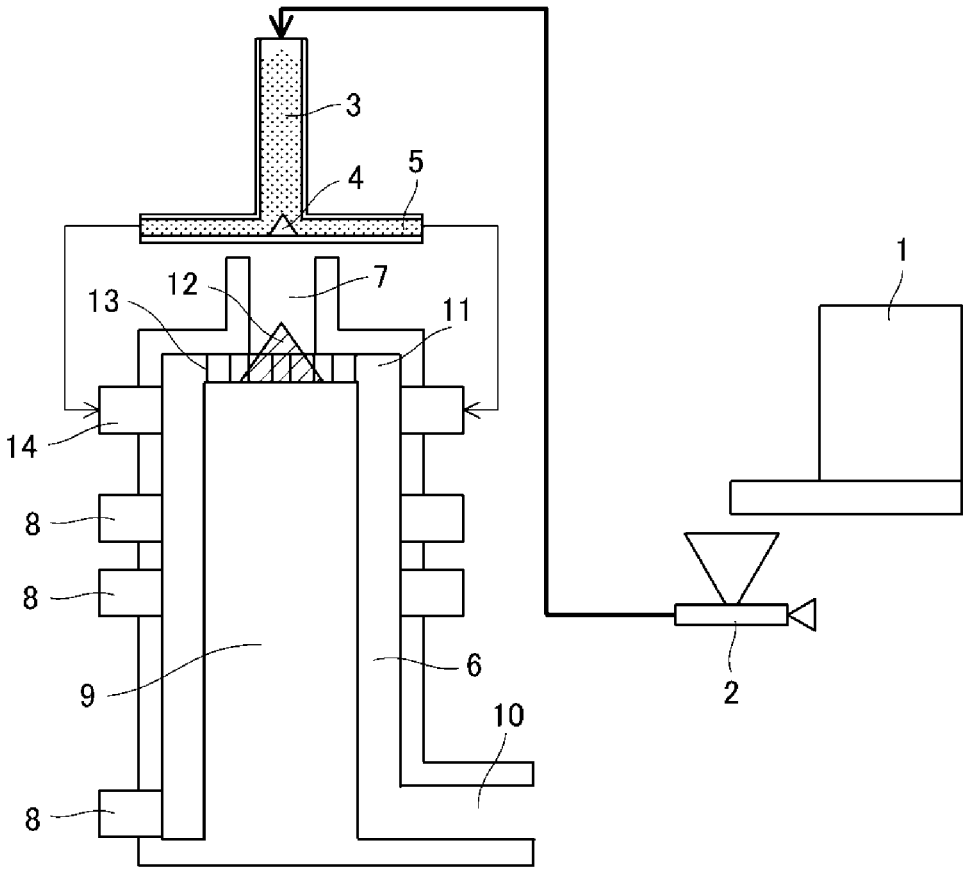
FIG. 1 is a schematic diagram of a heat treatment apparatus.

Embodiments of the present invention are described in the following.

The toner of the present invention is a toner comprising a toner particle that contains an amorphous resin, a crystalline polyester, and a wax, wherein the toner particle comprises, at the surface thereof, a coat layer containing a cyclic polyolefin resin.

The present invention was achieved through the discovery that the migration of the crystalline polyester present in a toner particle to the toner particle surface could be suppressed by the toner particle having, at the surface thereof, a coat layer that contains a cyclic polyolefin resin.

The reason why the aforementioned problems are solved in the present invention is thought to be as follows.

The addition of crystalline polyester having a plasticizing action on the amorphous resin is effective for improving the low-temperature fixability. However, a crystalline polyester-containing toner, while due to its properties having a sharp melt property and exhibiting an excellent low-temperature fixability, suffers from the problem of an unsatisfactory durability.

For example, under circumstances in which the toner is exposed to a high-temperature environment or mechanical stress, the crystalline polyester in the toner can migrate to the toner particle surface. This is thought to be due to the following: crystalline polyester has a lower polarity than amorphous polyester and thus has a higher affinity for nonpolar air. In this case, the possibility exists for the crystalline polyester to melt upon the application of heat and for the surface of the toner particle to then undergo softening. As a result, a reduction in toner flowability is produced due to, for example, the changes in the toner particle surface and the burying of the external additive, and the durability of the toner in long-term use is reduced.

In addition, filming is produced when the crystalline polyester of the toner particle surface melts and attaches to a member, and this causes a reduction in the service life of members as well as image defects.

Moreover, the electrical resistance value of the toner is lowered in a high-humidity environment due to the hygroscopicity brought about by the polar groups present in the crystalline polyester molecule. The charge quantity for the toner is lowered as result. This problem is produced to a substantial degree when the crystalline polyester is present at the surface of the toner particle.

Thus, when a crystalline polyester is used, it is important that the crystalline polyester not be present at the toner particle surface and that, even under circumstances in which the toner is exposed to a high-temperature environment or mechanical stress, a state be maintained in which the crystalline polyester does not migrate to the toner particle surface.

In the present invention, the toner particle comprises, at the surface thereof, a coat layer that contains a cyclic polyolefin resin. This coat layer may contain known resins other than the cyclic polyolefin resin within a range in which the effects of the present invention are not impaired.

Since the toner particle has this coat layer, the interior of the crystalline polyester-containing toner particle is covered by the coat layer at the surface, and due to this a state is assumed in which the presence of the crystalline polyester at the toner particle surface is impeded.

In addition, when exposure to a high-temperature environment or mechanical stress occurs, a state can be maintained in which migration by the crystalline polyester to the toner particle surface is impeded.

The mechanism here is thought to be as follows. The polarity of the crystalline polyester is lower than that of amorphous polyester and higher than that of cyclic polyolefin resin. Due to this, it is an energetically stable state for the cyclic polyolefin resin to be present at the toner particle surface so as to be in contact with nonpolar air and for the crystalline polyester, on the other hand, to be present in the amorphous polyester in the toner interior. It is thought that migration by the crystalline polyester to the toner particle surface can therefore be suppressed by the presence of this coat layer at the toner particle surface.

The coat layer of the toner particle according to the present invention preferably satisfies the following two features in observation of the toner particle cross section using a transmission electron microscope (TEM).

1) The average layer thickness of the coat layer at the toner particle surface is at least 0.1 μm and not more than 1.0 μm.

2) The coverage ratio by the coat layer with respect to the toner particle is at least 90%.

Having the average layer thickness of the coat layer satisfy the indicated range is advantageous from the standpoints of inhibiting migration of the crystalline polyester to the toner particle surface and inhibiting the decline in the durability of the toner during long-term use, inhibiting the decline in the charge quantity on the toner in high-humidity environments, and inhibiting image defects and the reduction in member service life.

Moreover, when the toner is fixed to paper at low temperatures, a favorable outmigration by the crystalline polyester in the toner to the toner particle surface is obtained and the decline in fixing strength by the toner to the paper can be prevented. On the other hand, when the coverage ratio by the coat layer with respect to the toner particle satisfies the range indicated above, there is then little exposure of the toner particle surface, which is advantageous from the standpoint of suppressing migration by the crystalline polyester to the toner particle surface even under exposure to a high-temperature environment or mechanical stress. This is also advantageous from the standpoints of inhibiting the decline in the durability of the toner during long-term use, inhibiting the decline in the charge quantity on the toner in high-humidity environments, and inhibiting image defects and the reduction in member service life.

Methods for determining the average layer thickness of the coat layer and the coverage ratio by the coat layer with respect to the toner particle are described below.

The formation of the cyclic polyolefin resin-containing coat layer can be carried out according to known methods, e.g., external addition methods, heat treatment methods, fluidized bed methods, wet methods, and so forth.

In the case of external addition methods, cyclic polyolefin resin particles may be electrostatically adsorbed to the toner particle surface using a mixing apparatus followed by formation of the coat layer by the application of pressure to the toner particle surface by mechanical impact and causing all or a portion of the cyclic polyolefin resin to undergo melting. The mixing apparatus here can be exemplified by the Mechano Hybrid (Nippon Coke & Engineering Co., Ltd.), Nobilta (Hosokawa Micron Corporation), and mechanofusion devices.

In the case of heat treatment methods, cyclic polyolefin resin particles may be electrostatically adsorbed to the toner particle surface followed by the formation of the coat layer by causing all or a portion of the cyclic polyolefin resin to undergo melting through the application of a heat treatment.

In the case of fluidized bed methods, production is carried out by forming a fluidized bed of the toner particles, spray-coating particles or a solution of the cyclic polyolefin resin onto this fluidized bed, and forming the coat layer by drying off the solvent present in the solution. For example, an SFP particle coating/granulation apparatus (Powrex Corporation) can be used to carry out fluidized bed methods.

In the case of wet methods, the coat layer is formed by immersing the toner particle in a solution of the cyclic polyolefin resin and carrying out mixing and stirring with a screw and drying. For example, a Nauta mixer can be used to carry out wet methods. Moreover, in the case of a seed method (emulsion polymerization), the coat layer can be formed by adding an olefin monomer solution to a toner particle dispersion and polymerizing the olefin monomer at the toner particle surface. In the case of the emulsion aggregation method, the coat layer can be formed by adding a dispersion of cyclic polyolefin resin particles to a toner particle dispersion and inducing attachment of the resin particles to the toner particle surface. The obtained toner can be easily isolated from the reaction system by common methods for isolation and purification, e.g., filtration, washing with pure water, vacuum drying and so forth.

The content of the cyclic polyolefin resin in the present invention, per 100 mass parts of the toner particle, is preferably at least 1 mass part and not more than 20 mass parts and more preferably at least 3 mass parts and not more than 10 mass parts.

A step is preferably carried out in the present invention in which a heat treatment is performed on the toner particle in a state in which the cyclic polyolefin resin is present at the surface layer of the toner particle. The reason is thought to be as follows.

It is ordinarily possible with a heat-treated toner for the crystalline polyester, which has a low melt viscosity, to migrate to the toner particle surface. When this occurs, the crystalline polyester of the toner particle surface softens, and as a result, a reduction in toner flowability is produced due to the changes in the surface and the burying of the external additive, and the durability is reduced.

In addition, filming is produced when the crystalline polyester of the toner particle surface melts and attaches to a member, and this causes a reduction in the service life of members as well as image defects.

However, when a heat treatment is executed on a toner particle in a state in which the cyclic polyolefin resin is present at the surface layer of the toner particle, the cyclic polyolefin undergoes melting and a uniform resin layer can then be formed at the toner particle surface. Due to this, there is little area on the toner particle surface where the interior of the toner particle is exposed and the percentage where the crystalline polyester migrates to the toner particle surface is diminished. As result, the reduction in durability, member contamination, and the reduction in charge quantity are even more thoroughly suppressed. In addition, the excellent low-temperature fixability, provided during fixing by the sharp melt property possessed by the crystalline polyester, is exhibited to a greater degree.

The amorphous resin (also referred to hereafter as the binder resin) in the present invention can be selected from heretofore known amorphous resins based on considerations such as, for example, enhancing pigment dispersibility and improving the charging performance and blocking resistance of the toner.

The following resins and polymers can be provided as specific examples:

homopolymers of styrene or a derivative thereof, e.g., polystyrene, poly-p-chlorostyrene, and polyvinyltoluene; styrene copolymers such as styrene-p-chlorostyrene copolymer, styrene-vinyltoluene copolymer, styrene-vinylnaphthalene copolymer, styrene-acrylate ester copolymers, styrene-methacrylate ester copolymers, styrene-methyl α-chloromethacrylate copolymer, styrene-acrylonitrile copolymer, styrene-vinyl methyl ether copolymer, styrene-vinyl ethyl ether copolymer, styrene-vinyl methyl ketone copolymer, and styrene-acrylonitrile-indene copolymer; and also polyvinyl chloride, phenolic resins, natural resin-modified phenolic resins, natural resin-modified maleic acid resins, acrylic resins, methacrylic resins, polyvinyl acetate, silicone resins, polyester resins, polyurethane resins, polyamide resins, furan resins, epoxy resins, xylene resins, polyvinyl butyral resins, terpene resins, coumarone-indene resins, and petroleum resins.

Among the preceding, it is preferable from the standpoint of bringing about an enhanced durability that the amorphous resin contain amorphous polyester resin as its main component. Here, "main component" means that the content of amorphous polyester resin in the amorphous resin is at least 50 mass %. The content of amorphous polyester resin in the amorphous resin is more preferably at least 70 mass % and still more preferably at least 90 mass %, and particularly preferably the amorphous resin is amorphous polyester resin.

The monomer used to produce this amorphous polyester resin can be exemplified by polyhydric alcohols (dihydric alcohols or at least trihydric alcohols) and polybasic carboxylic acids (dibasic carboxylic acids or at least tribasic carboxylic acids) and their anhydrides and lower alkyl esters.

Partial crosslinking within the amorphous resin molecule is effective here for producing a branched polymer, and an at least trivalent polyvalent compound is preferably used for this.

Accordingly, when a branched polymer is to be produced, an at least tribasic carboxylic acid or its anhydride or lower alkyl ester and/or an at least trihydric alcohol is preferably present in the starting monomer.

The polyhydric alcohols can be specifically exemplified as follows.

Examples of dihydric alcohols are ethylene glycol, propylene glycol, 1,3-butanediol, 1,4-butanediol, 2,3-butanediol, diethylene glycol, triethylene glycol, 1,5-pentanediol, 1,6-hexanediol, neopentyl glycol, 2-ethyl-1,3-hexanediol, hydrogenated bisphenol A, bisphenol derivatives given by the following formula (I), the hydrogenates of formula (I), and diols given by the following formula (II).

(I)

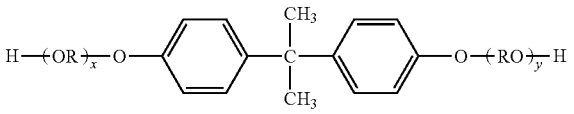

(In the formula, R is an ethylene group or propylene group; x and y are each integers equal to or greater than 0; and the average value of x+y is at least 0 and not more than 10.)

(II)

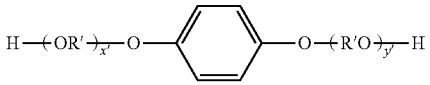

(In the formula, R' is

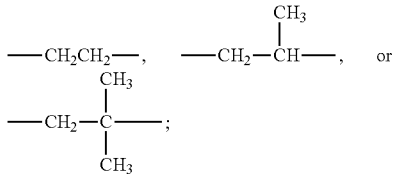

x' and y' are each integers equal to or greater than 0; and the average value of x'+y' is at least 0 and not more than 10.)

Examples of the at least trihydric alcohols are sorbitol, 1,2,3,6-hexanetetrol, 1,4-sorbitan, pentaerythritol, dipentaerythritol, tripentaerythritol, 1,2,4-butanetriol, 1,2,5-pentanetriol, glycerol, 2-methylpropanetriol, 2-methyl-1,2,4-butanetriol, trimethylolethane, trimethylolpropane, and 1,3,5-trihydroxymethylbenzene. Glycerol, trimethylolpropane, and pentaerythritol are advantageous examples from among the preceding.

A single dihydric alcohol may be used by itself or a plurality may be used in combination, and a single at least trihydric alcohol may be used by itself or a plurality may be used in combination.

Specific examples of polybasic carboxylic acids are as follows.

The dibasic carboxylic acids can be exemplified by maleic acid, fumaric acid, citraconic acid, itaconic acid, glutaconic acid, phthalic acid, isophthalic acid, terephthalic acid, succinic acid, adipic acid, sebacic acid, azelaic acid, malonic acid, n-dodecenylsuccinic acid, isododecenylsuccinic acid, n-dodecylsuccinic acid, isododecylsuccinic acid, n-octenylsuccinic acid, n-octylsuccinic acid, isooctenylsuccinic acid, isooctylsuccinic acid, and their anhydrides and lower alkyl esters. Maleic acid, fumaric acid, terephthalic acid, and n-dodecenylsuccinic acid are advantageous examples among the preceding.

The at least tribasic carboxylic acids can be exemplified by 1,2,4-benzenetricarboxylic acid, 2,5,7-naphthalenetricarboxylic acid, 1,2,4-naphthalenetricarboxylic acid, 1,2,4-butanetricarboxylic acid, 1,2,5-hexanetricarboxylic acid, 1,3-dicarboxy-2-methyl-2-methylenecarboxypropane, 1,2,4-cyclohexanetricarboxylic acid, tetra(methylenecarboxy) methane, 1,2,7,8-octanetetracarboxylic acid, pyromellitic acid, and Empol trimer acid. In addition, the anhydrides and lower alkyl esters of the preceding may be used.

Among the preceding, the use of 1,2,4-benzenetricarboxylic acid, i.e., trimellitic acid, and derivatives thereof is preferred because they are inexpensive and facilitate control of the reaction.

A single dibasic carboxylic acid may be used by itself or a plurality may be used in combination, and a single at least tribasic carboxylic acid may be used by itself or a plurality may be used in combination.

The amorphous resin may also take the form of a hybrid resin in which an amorphous polyester resin is bonded with another amorphous resin.

An example is a hybrid resin in which an amorphous polyester resin is bonded to an amorphous vinyl resin. The method for producing this hybrid resin can be exemplified by a method in which a polymerization reaction for either resin or both resins is carried out in the presence of a polymer that contains a monomer component that can react with each of the amorphous vinyl resin and amorphous polyester resin.

Among monomers that can constitute amorphous polyester resins, monomer that can react with vinyl resin can be exemplified by unsaturated dicarboxylic acids such as fumaric acid, maleic acid, citraconic acid, and itaconic acid and their anhydrides. On the other hand, among monomers that can constitute amorphous vinyl resins, monomer that can react with amorphous polyester resin can be exemplified by monomer that contains a carboxy group or hydroxy group and by acrylate esters and methacrylate esters.

The acid value of the amorphous resin is preferably at least 15 mg KOH/g and not more than 30 mg KOH/g from the standpoint of the charging performance in high-temperature, high-humidity environments. The hydroxyl value of the amorphous resin, on the other hand, is preferably at least 2 mg KOH/g and not more than 20 mg KOH/g from the standpoint of the low-temperature fixability and the storability.

A mixture of a low molecular weight amorphous resin A and a high molecular weight amorphous resin B may be used for the amorphous resin. The content ratio (B/A) of the amorphous resin B to the amorphous resin A, expressed on a mass basis, is preferably at least 10/90 and not more than 60/40 from the standpoint of the low-temperature fixability and the hot offset resistance.

The softening point of the amorphous resin A is preferably at least 70° C. and less than 100° C. from the standpoint of the low-temperature fixability.

The softening point of the amorphous resin B, on the other hand, is preferably at least 100° C. and not more than 150° C. from the standpoint of the hot offset resistance.

The abundance ratio of oxygen atoms to carbon atoms in the present invention according to surface analysis of the toner by x-ray photoelectron spectroscopy (XPS) is preferably at least 0.0% and not more than 20.0% and is more preferably at least 0.0% and not more than 15.0%.

This abundance ratio of oxygen atoms to carbon atoms is the ratio calculated using (0 atm %/C atm %)×100 where 0 (atm %) is the amount of occurrence of oxygen atom deriving from the crystalline polyester at the toner particle surface and C (atm %) is the amount of occurrence of carbon atom deriving from the cyclic polyolefin resin at the toner particle surface.

This abundance ratio correlates with the abundances of the crystalline polyester and the cyclic polyolefin resin at the toner particle surface.

When this abundance ratio satisfies the indicated range, the cyclic polyolefin resin is then abundantly present at the toner particle surface and because of this the hydrophobicity of the toner particle surface is increased and a decline in the charge quantity in high-temperature, high-humidity environments is inhibited.

In addition, due to the low affinity between the cyclic polyolefin resin and the crystalline polyester, migration by the crystalline polyester to the toner particle surface is impeded and migration of the crystalline polyester into the interior of the toner so as to separate from the cyclic polyolefin resin is made easier.

As a result, a state can be maintained in which the presence of the crystalline polyester at the toner particle surface is impeded and the reduction in member service life due to member contamination can be suppressed and the generation of image defects due to fluctuations in the quantity of charge can be inhibited.

This abundance ratio can be controlled into the aforementioned range by having a coat layer containing the cyclic polyolefin resin at the toner particle surface.

There are no particular limitations in the present invention on the cyclic polyolefin resin as long as it is a polymer that contains a cyclic olefin component in the molecular chain, and, for example, a homopolymer of a cyclic olefin, or a copolymer of ethylene and/or α-olefin with cyclic olefin can be used.

Among these, a copolymer of ethylene and/or α-olefin with cyclic olefin is preferred; a copolymer of ethylene and/or α-olefin with a compound having a norbornene structure in the main skeleton thereof is more preferred; and a copolymer of ethylene and norbornene is even more preferred. This is because ethylene/norbornene copolymers are colorless and transparent and have a high light transmittance.

The α-olefin can be exemplified by propylene, butylene, 1-butene, 1-octene, 1-decene, 1-dodecene, 1-tetradecene, 1-hexadecene, 1-octadecene, and 1-eicosene.

Among these, α-olefin having 2 to 12 carbons is preferred and α-olefin having 2 to 6 carbons is more preferred.

One of ethylene and α-olefin can be used by itself or two or more of these may be used in combination.

When ethylene and/or α-olefin is used, these have a high affinity with the wax and as a consequence during fixing and melting the wax rapidly migrates to the surface of the melted toner particle and the releasability is thereby enhanced.

With regard to the cyclic olefin, on the other hand, those having 3 to 17 carbons are preferred and those having 5 to 12 carbons are more preferred.

The cyclic olefin is preferably a compound having the norbornene structure in the main skeleton. Examples are norbornene, norbornadiene, isobornene, tetracyclododecene, and dicyclopentadiene.

A compound having the norbornene structure in the main skeleton has a suitable steric bulkiness and, due to its resulting steric hindrance and its low polarity, the development of surface migration by the crystalline polyester is impeded. Due to this, the generation of filming at the carrier, developing sleeve, photosensitive member, and so forth, is impeded and reductions in member service life and image defects can be substantially prevented.

The cyclic olefin may be a substituted cyclic olefin in which one or two or more substituents are bonded. The substituent can be exemplified by alkyl groups such as the methyl group, ethyl group, propyl group, and butyl group; alkenyl groups such as the vinyl group; alkylidene groups such as the ethylidene group; and aryl groups such as the phenyl group, tolyl group, and naphthyl group.

A single one of these cyclic olefins can be used by itself or two or more may be used in combination.

The copolymers of ethylene and/or α-olefin with cyclic olefin can be produced using known copolymerization reactions.

For example, the copolymerization reaction may be executed in a suitable solvent in the presence of a catalyst used in double bond-opening reactions and/or ring-opening polymerization reactions.

Specific examples of this catalyst are metallocene catalysts (those containing, for example, zirconium or hafnium), Ziegler catalysts, and metathesis polymerization catalysts.

A favorable specific example of the copolymerization reaction is the reaction of a cyclic olefin with ethylene and/or α-olefin in the presence of one or two or more catalysts at a temperature of −78° C. to 150° C. (preferably 20° C. to 80° C.) and under a pressure of $1\times10^3$ to $64\times10^5$ Pa.

A cocatalyst such as aluminoxane may also be added to this reaction system.

There are no particular limitations on the use proportion between the ethylene and/or α-olefin and the cyclic olefin, and it can be selected as appropriate from a broad range in conformity with, for example, the type of copolymer resin that will be obtained; however, 50:1 to 1:50 as the molar ratio is preferred and 20:1 to 1:20 as the molar ratio is more preferred.

For example, when norbornene is used as the cyclic olefin, the glass transition temperature (Tg) of the resulting cyclic polyolefin resin varies in correspondence to the use proportion for the norbornene.

When the amount of use of the norbornene is increased, Tg also assumes an increasing trend. For example, Tg is about 60° C. to 70° C. when the use amount of the norbornene is made approximately 60 mass % of the total of the amount of ethylene used and the amount of norbornene used.

Moreover, properties such as the number-average molecular weight, softening point, melting point, viscosity, dielectric properties, non-offset temperature range, transparency, molecular weight, molecular weight distribution, and so forth can also be adjusted to desired values through the suitable selection of, e.g., the type of monomer used and the use proportions therefor.

When a metallocene catalyst is used, an inert hydrocarbon such as an aliphatic hydrocarbon, aromatic hydrocarbon, and so forth is preferred for the reaction solvent. The copolymerization runs smoothly when, for example, the metallocene catalyst is dissolved in toluene and preliminarily activated.

Viewed in terms of the durability and charging performance, the glass transition temperature (Tg) of the cyclic polyolefin resin in the present invention is preferably 65° C. to 105° C. and is more preferably 75° C. to 85° C. When the glass transition temperature is established in the range from 65° C. to 105° C., the melting point then becomes 120° C. to 160° C. and a satisfactory durability can be imparted.

A known condensation polymer from a polybasic carboxylic acid and a polyol can be used as the aforementioned crystalline polyester.

Preferred thereamong are condensation polymers from aliphatic diols having at least 4 and not more than 18 carbons and aliphatic dicarboxylic acids having at least 4 and not more than 18 carbons.

The reason that the low-temperature fixability of the toner is improved by the use of the crystalline polyester is thought to be as follows: the crystalline polyester is compatible with the amorphous resin, resulting in a widening of the spacing between the molecular chains of the amorphous resin and thus a weakening of the intermolecular forces. As a consequence, the glass transition temperature (Tg) is substantially lowered and a state is assumed in which the melt viscosity is low. Thus, it is thought that the low-temperature fixability is improved by increasing the compatibility between the amorphous resin and crystalline polyester.

The following are preferred for increasing the compatibility between the amorphous resin and the crystalline polyester: using a low number of carbons for the monomer (for example, aliphatic diol and/or aliphatic dicarboxylic acid) that constitutes the crystalline polyester, increasing the ester group concentration, and raising the polarity.

On the other hand, for a toner that has a substantially reduced Tg, the outmigration of the crystalline polyester to the toner particle surface under mechanical stress or in a high-temperature, high-humidity environment must also be inhibited.

When a toner is exposed to such environments, it is necessary that the compatibilized crystalline polyester in the toner undergo recrystallization and the Tg of the toner be returned to the Tg of the amorphous resin.

Here, when the crystalline polyester has a high ester group concentration and the compatibility between the amorphous resin and crystalline polyester is too high, recrystallization of the crystalline polyester is impeded and member contamination, e.g., filming due to the development of outmigration to the toner surface, is readily produced.

In view of the preceding, it is then more preferable from the standpoint of bringing about co-existence between the low-temperature fixability and the inhibition of outmigration that the crystalline polyester be a condensation polymer of aliphatic diol having at least 6 and not more than 12 carbons with aliphatic dicarboxylic acid having at least 6 and not more than 12 carbons.

The content of the crystalline polyester, per 100.0 mass parts of the amorphous resin, is preferably at least 1.0 mass part and not more than 15.0 mass parts and is more preferably at least 3.0 mass parts and not more than 10.0 mass parts.

When the crystalline polyester content is in the indicated range, the low-temperature fixability is satisfactorily enhanced and the crystalline polyester is also readily microfinely dispersed in the toner particle.

The aforementioned wax can be exemplified by the following:

hydrocarbon waxes such as low molecular weight polyethylene, low molecular weight polypropylene, alkylene copolymers, microcrystalline waxes, paraffin waxes, and Fischer-Tropsch waxes; oxides of hydrocarbon waxes, e.g., oxidized polyethylene wax, and their block copolymers; waxes in which the main component is a fatty acid ester, such as carnauba wax; and waxes provided by the partial or complete deacidification of fatty acid esters, such as deacidified carnauba wax. Additional examples are as follows: saturated linear fatty acids such as palmitic acid, stearic acid, and montanic acid; unsaturated fatty acids such as brassidic acid, eleostearic acid, and parinaric acid; saturated alcohols such as stearyl alcohol, aralkyl alcohols, behenyl alcohol, carnaubyl alcohol, ceryl alcohol, and melissyl alcohol; polyhydric alcohols such as sorbitol; esters between fatty acids such as palmitic acid, stearic acid, behenic acid, or montanic acid, and alcohols such as stearyl alcohol, aralkyl alcohol, behenyl alcohol, carnaubyl alcohol, ceryl alcohol, or melissyl alcohol; fatty acid amides such as linoleamide, oleamide, and lauramide; saturated fatty acid bisamides such as methylenebisstearamide, ethylenebiscapramide, ethylenebislauramide, and hexamethylenebisstearamide; unsaturated fatty acid amides such as ethylenebisoleamide, hexamethylenebisoleamide, N,N'-dioleyladipamide, and N,N'-dioleylsebacamide; aromatic bisamides such as m-xylenebisstearamide and N,N'-distearylisophthalamide; fatty acid metal salts (generally known as metal soaps) such as calcium stearate, calcium laurate, zinc stearate, and magnesium stearate; waxes provided by grafting onto an aliphatic hydrocarbon wax using a vinyl monomer such as styrene or acrylic acid; partial esters between a polyhydric alcohol and a fatty acid, such as behenic monoglyceride; and hydroxy group-containing methyl ester compounds obtained by the hydrogenation of plant oils.

Among these waxes, hydrocarbon waxes such as paraffin waxes and Fischer-Tropsch waxes and fatty acid ester waxes such as carnauba wax are preferred from the standpoint of bringing about an improved low-temperature fixability and an enhanced hot offset resistance. Hydrocarbon waxes are more preferred for the present invention because they provide additional enhancements in the hot offset resistance.

The wax content is preferably at least 1 mass part and not more than 20 mass parts per 100 mass parts of the amorphous resin.

The peak temperature of the maximum endothermic peak for the wax in the endothermic curve during ramp up as measured with a differential scanning calorimeter is preferably at least 45° C. and not more than 140° C. The peak temperature of the maximum endothermic peak for the wax is preferably in the indicated range because this makes it possible for the toner storability to co-exist with the hot offset resistance.

The toner particle of the present invention may contain a colorant. This colorant can be exemplified as follows.

The black colorants can be exemplified by carbon black and by black colorants obtained by color mixing using a yellow colorant, magenta colorant, and cyan colorant to give a black color.

A pigment may be used by itself for the colorant, but the enhanced sharpness provided by the co-use of a dye with a pigment is more preferred from the standpoint of the image quality of full-color images.

Pigments for magenta toners can be exemplified by C.I. Pigment Red 1, 2, 3, 4, 5, 6, 7, 8, 9, 10, 11, 12, 13, 14, 15, 16, 17, 18, 19, 21, 22, 23, 30, 31, 32, 37, 38, 39, 40, 41, 48:2, 48:3, 48:4, 49, 50, 51, 52, 53, 54, 55, 57:1, 58, 60, 63, 64, 68, 81:1, 83, 87, 88, 89, 90, 112, 114, 122, 123, 146, 147, 150, 163, 184, 202, 206, 207, 209, 238, 269, and 282; C.I. Pigment Violet 19; and C.I. Vat Red 1, 2, 10, 13, 15, 23, 29, and 35.

Dyes for magenta toners can be exemplified by oil-soluble dyes such as C.I. Solvent Red 1, 3, 8, 23, 24, 25, 27, 30, 49, 81, 82, 83, 84, 100, 109, and 121; C.I. Disperse Red 9; C.I. Solvent Violet 8, 13, 14, 21, and 27; and C.I. Disperse Violet 1, and basic dyes such as C.I. Basic Red 1, 2, 9, 12, 13, 14, 15, 17, 18, 22, 23, 24, 27, 29, 32, 34, 35, 36, 37, 38, 39, and 40 and C.I. Basic Violet 1, 3, 7, 10, 14, 15, 21, 25, 26, 27, and 28.

Pigments for cyan toners can be exemplified by C.I. Pigment Blue 2, 3, 15:2, 15:3, 15:4, 16, and 17; C.I. Vat Blue 6; C.I. Acid Blue 45; and copper phthalocyanine pigments having 1 to 5 phthalimidomethyl groups substituted on the phthalocyanine skeleton.

C.I. Solvent Blue 70 is a dye for cyan toners.

Pigments for yellow toners can be exemplified by C.I. Pigment Yellow 1, 2, 3, 4, 5, 6, 7, 10, 11, 12, 13, 14, 15, 16, 17, 23, 62, 65, 73, 74, 83, 93, 94, 95, 97, 109, 110, 111, 120, 127, 128, 129, 147, 151, 154, 155, 168, 174, 175, 176, 180, 181, and 185 and C.I. Vat Yellow 1, 3, and 20.

C.I. Solvent Yellow 162 is a dye for yellow toners.

The colorant content is preferably at least 0.1 mass parts and not more than 30 mass parts per 100 mass parts of the amorphous resin.

The toner may as necessary also contain a charge control agent in the present invention. Known charge control agents can be used as the charge control agent incorporated in the toner, but metal compounds of aromatic carboxylic acids that are colorless, support a rapid toner charging speed, and enable the stable maintenance of a certain charge quantity are particularly preferred.

Negative-charging charge control agents can be exemplified by metal salicylate compounds, metal naphthoate compounds, metal dicarboxylate compounds, polymer compounds having sulfonic acid or carboxylic acid in side chain position, polymer compounds having sulfonate salt or sulfonate ester in side chain position, polymer compounds having carboxylate salt or carboxylate ester in side chain position, boron compounds, urea compounds, silicon compounds, and calixarene.

Positive-charging charge control agents can be exemplified by quaternary ammonium salts, polymer compounds having such quaternary ammonium salts in side chain position, guanidine compounds, and imidazole compounds.

The charge control agent may be internally added or externally added to the toner particle.

The content of the charge control agent is preferably at least 0.2 mass parts and not more than 10 mass parts per 100 mass parts of the amorphous resin.

The toner in the present invention may as necessary contain inorganic fine particles.

These inorganic fine particles may be internally added to the toner particle or may be mixed with the toner particle as an external additive. Inorganic fine particles such as silica fine particles, titanium oxide fine particles, and aluminum oxide fine particles are preferred as external additives. The inorganic fine particles are preferably hydrophobed with a hydrophobic agent such as a silane compound, a silicone oil, or a mixture thereof.

When used as an external additive in order to improve the flowability, inorganic fine particles having a specific surface area of at least 50 $m^2/g$ and not more than 400 $m^2/g$ are preferred; in order to stabilize the durability, inorganic fine particles having a specific surface area of at least 10 $m^2/g$ and not more than 50 $m^2/g$ are preferred.

Combinations of inorganic fine particles having specific surface areas in the indicated ranges may be used in order to bring about co-existence between flowability improvement and stabilization of the durability.

The content of this external additive is preferably at least 0.1 mass parts and not more than 10.0 mass parts per 100 mass parts of the toner particle. A known mixer, such as a Henschel mixer, can be used to mix the toner particle with the external additive.

The toner of the present invention may also be used as a single-component developer, but in order to bring about additional enhancements in the dot reproducibility it is preferably mixed with a magnetic carrier and used as a two-component developer. Use as a two-component developer is also preferred from the standpoint of obtaining a consistent image on a long-term basis.

A commonly known magnetic carrier can be used for the magnetic carrier, such as a surface oxidized iron power or an unoxidized iron powder; metal particles of, e.g., iron, lithium, calcium, magnesium, nickel, copper, zinc, cobalt, manganese, chromium, or a rare earth, as well as alloy particles of the preceding and oxide particles of the preceding; magnetic bodies such as ferrite; and magnetic body-dispersed resin carriers (known as resin carriers), which contain a magnetic body and a binder resin that holds this magnetic body in a dispersed state.

When the toner of the present invention is used mixed with a magnetic carrier as a two-component developer, the content of the toner in the two-component developer is preferably at least 2 mass % and not more than 15 mass % and more preferably at least 4 mass % and not more than 13 mass %.

The method of producing the toner particle in the present invention may be a heretofore known production method, e.g., the emulsion aggregation method, melt-kneading method, dissolution suspension method, and so forth, but is not otherwise particularly limited; however, the melt-kneading method is preferred from the standpoint of starting material dispersity.

Thus, the hereabove-described toner particle is preferably obtained by melt-kneading a toner composition containing the amorphous resin, crystalline polyester, and wax and pulverizing the obtained kneaded material.

The dispersity of the crystalline polyester and wax can be substantially enhanced in the present invention by producing the toner particle by proceeding through a melt-kneading step.

It is hypothesized here that, for a toner produced using a production method that includes a melt-kneading step, the starting materials for the toner particle are strongly mixed under the application of heat and shear during the melt-kneading and as a result the dispersity of the crystalline polyester and wax in the toner particle is improved when the toner particle has been made. As a result, the wax is microfinely dispersed in the toner particle and the hot offset resistance is enhanced. In addition, outmigration to the toner particle surface by the crystalline polyester and wax in an environment of mechanical stress and in high-temperature, high-humidity environments is inhibited and an even better durability is exhibited.

A specific example of the melt-kneading method is described in the following, but this should not be construed as a limitation thereto.

First, in a starting material mixing step, the amorphous resin, crystalline polyester, and wax and additional optional components, e.g., colorant and so forth, are weighed out in prescribed amounts and are blended and mixed.

The mixing apparatus can be exemplified by a double cone mixer, V-mixer, drum mixer, Supermixer, Henschel mixer, Nauta mixer, and Mechano Hybrid (Nippon Coke & Engineering Co., Ltd.).

The mixed material is then melt-kneaded and the other starting materials are thereby dispersed in the amorphous resin. A batch kneader, e.g., a pressure kneader or Banbury mixer, or a continuous kneader can be used in the melt-kneading step, and single-screw extruders and twin-screw extruders are the mainstream here because they offer the advantage of enabling continuous production. Examples here are the Model KTK twin-screw extruder (Kobe Steel, Ltd.), Model TEM twin-screw extruder (Toshiba Machine Co., Ltd.), PCM kneader (Ikegai Corp), Twin Screw Extruder (KCK), Co-Kneader (Buss AG), and Kneadex (Nippon Coke & Engineering Co., Ltd.).

The kneaded material yielded by melt-kneading may be rolled out using, for example, a two-roll mill, and may be cooled in a cooling step using, for example, water.

The obtained kneaded material is then pulverized to a desired particle diameter. In this pulverization step, a coarse pulverization may be performed using a grinder such as a crusher, hammer mill, or feather mill, followed, for example, by a fine pulverization using a fine pulverizer such as a Kryptron System (Kawasaki Heavy Industries, Ltd.), Super Rotor (Nisshin Engineering Inc.), or Turbo Mill (Turbo Kogyo Co., Ltd.) or using an air jet system.

The toner particle is then obtained as necessary by carrying out classification using a sieving apparatus or a classifier, e.g., an internal classification system such as the Elbow Jet (Nittetsu Mining Co., Ltd.) or a centrifugal classification system such as the Turboplex (Hosokawa Micron Corporation), TSP Separator (Hosokawa Micron Corporation), or Faculty (Hosokawa Micron Corporation).

The toner is obtained by forming a coat layer containing a cyclic polyolefin resin at the toner particle surface using the method described above.

The emulsion aggregation method will now be described as another production method.

A toner particle is produced in the emulsion aggregation method by preliminarily preparing an aqueous dispersion of fine particles that contain the constituent materials for the toner particle and that are substantially smaller than the desired particle diameter, aggregating these fine particles in an aqueous medium until the desired particle diameter is reached, and melt-adhering the resin by heating.

That is, a toner having a cyclic polyolefin resin-containing coat layer at the surface of the toner particle is produced in the emulsion aggregation method by proceeding through a dispersion step, in which a dispersion is produced of fine particles that contain the constituent materials for the toner particle; an aggregation step, in which the fine particles that contain the constituent materials for the toner particle are aggregated and the particle diameter is controlled until the desired particle diameter is reached; a shell attachment step, in which—through the addition, to the resulting dispersion of aggregate particles, of cyclic polyolefin resin fine particles for forming an additional shell phase—cyclic polyolefin resin fine particles are attached to the surface of the aggregate particle; a fusion step, in which the aggregate particle having the cyclic polyolefin fine particles attached at the surface is caused to undergo fusion; and a cooling step.

The aqueous dispersions of fine particles of the amorphous resin, the crystalline polyester, and the cyclic polyolefin resin (also collectively referred to herebelow as resin fine particles) can be prepared by known methods. Examples here are the phase inversion method, in which the resin is emulsified by the addition of an aqueous medium to a solution of the resin dissolved in an organic solvent, and the forced emulsification method, in which, without using an organic solvent, the resin is forcibly emulsified using a high-temperature treatment in an aqueous medium.

Specifically, the amorphous resin, crystalline polyester, or cyclic polyolefin resin is dissolved in an organic solvent that dissolves same and a surfactant and/or a basic compound is added. Then, while stirring with, e.g., a homogenizer, an aqueous medium is gradually added and resin fine particles are precipitated. After this, the solvent is removed by heating or reducing the pressure to produce an aqueous dispersion of resin fine particles. Any organic solvent capable of dissolving the resin can be used as the organic solvent used to dissolve the resin, but, for example, tetrahydrofuran, ethyl acetate, and chloroform are preferred from a solubility standpoint.

There are no particular limitations on the surfactant used during emulsification, and examples here are anionic surfactants such as sulfate ester salts, sulfonate salts, carboxylate salts, phosphate esters, and soaps; cationic surfactants such as amine salts and quaternary ammonium salts; and nonionic surfactants such as polyethylene glycol types, ethylene oxide adducts on alkylphenols, and polyhydric alcohol types. A single surfactant may be used by itself or two or more may be used in combination.

The basic compound used during emulsification can be exemplified by inorganic bases such as sodium hydroxide and potassium hydroxide and organic bases such as ammonia, triethylamine, trimethylamine, dimethylaminoethanol, and diethylaminoethanol. A single base may be used by itself or two or more may be used in combination.

The 50% particle diameter on a volume basis (d50) of the resin fine particles is preferably 0.05 μm to 1.0 μm and is more preferably 0.05 μm to 0.4 μm. The 50% particle diameter on a volume basis (d50) can be measured using a dynamic light scattering particle distribution analyzer (Nanotrac UPA-EX150, Nikkiso Co., Ltd.).

The aqueous dispersion of wax fine particles, on the other hand, can be produced by adding the wax to a surfactant-containing aqueous medium; inducing dispersion into particle form by heating to at least the melting point of the wax and using a homogenizer having a strong shearing capability (for example, the "Clearmix W-Motion", M Technique Co., Ltd.) or a pressure ejection disperser (for example, the "Gaulin Homogenizer", Manton-Gaulin Company); and subsequently cooling to below the melting point.

The dispersed particle diameter of the wax fine particles in the aqueous dispersion, expressed as the 50% particle diameter on a volume basis (d50), is preferably 0.03 μm to 1.0 μm and more preferably 0.1 μm to 0.5 μm.

In the aggregation step, a liquid mixture is prepared by mixing the aforementioned aqueous dispersion of amorphous resin fine particles, aqueous dispersion of crystalline polyester fine particles, and aqueous dispersion of wax fine particles. Aggregate particles with the desired particle diameter are then formed by aggregating the fine particles present in the thusly prepared liquid mixture. Here, aggregate particles provided by the aggregation of the amorphous resin fine particles, crystalline polyester fine particles, and wax fine particles are formed by the admixture of an aggregating agent and as necessary with the appropriate application of heating and/or mechanical force.

The aggregating agent can be exemplified by the metal salts of monovalent metals, e.g., sodium, potassium, and so forth; the metal salts of divalent metals, e.g., calcium, magnesium, and so forth; and the metal salts of trivalent metals, e.g., iron, aluminum, and so forth.

The addition and mixing of the aggregating agent is preferably carried out at a temperature that does not exceed the glass transition temperature of the resin particles present in the mixed liquid. When this mixing is performed using this temperature condition, aggregation then proceeds in a stable state.

The mixing of the aggregating agent into the liquid mixture may be carried out using a known mixing device, homogenizer, mixer, and so forth.

While there are no particular limitations on the volume-average particle diameter of the aggregate particles formed in the aggregation step, it is generally preferably controlled to at least 4.0 μm and not more than 7.0 μm so as to be about the same as the volume-average particle diameter of the toner particle that will be obtained. With regard to the control method, control is readily carried out by appropriately setting the temperature and stirring and mixing conditions during the addition and mixing of the aggregating agent. The particle diameter distribution of the toner particle can be measured using a particle size distribution analyzer that employs the Coulter principle (Coulter Multisizer III: from Beckman Coulter, Inc.).

In addition, cyclic polyolefin resin fine particles are attached, by the addition of cyclic polyolefin resin fine particles for the additional formation of a shell phase, to the aggregate particle dispersion obtained in this aggregation step.

In the fusion step, the aggregate particle having cyclic polyolefin resin fine particles attached to its surface is heated to at least the glass transition temperature of the resin and is fused, thereby producing a resin particle having a core/shell structure in which the surface of the aggregate particle has been smoothed out.

In order to prevent melt adhesion between the aggregate particles, a chelating agent, pH modifier, surfactant, and so forth may be added as appropriate prior to introduction into the fusion step.

The chelating agent can be exemplified by ethylenediaminetetraacetic acid (EDTA) and its salts with an alkali metal such as the Na salt, sodium gluconate, sodium tartrate, potassium citrate and sodium citrate, nitrilotriacetate (NTA) salts, and a large number of water-soluble polymers that contain both the COOH and OH functionalities (polyelectrolytes).

The heating temperature should be between the glass transition temperature of the resin present in the aggregate particle and the temperature at which the resin undergoes thermal decomposition. The time period for heating/fusion must be a shorter time when a higher heating temperature is used and a longer time when a lower heating temperature is used. That is, the heating/fusion time, while it cannot be unconditionally specified because it depends on the heating temperature, is generally from 10 minutes to 10 hours.

In the cooling step, the temperature of the resin particle-containing aqueous medium is cooled to a temperature below the glass transition temperature of the amorphous resin. The cooling rate is approximately at least 0.1° C./minute and not more than 50° C./minute. The resin particles produced proceeding through the above-described steps are washed with deionized water and filtered a plurality of times and then dried to obtain the toner.

After the coat layer has been formed by the addition of the cyclic polyolefin resin and so forth to the toner particle surface, in the present invention this coat layer is preferably fixed to the toner particle surface by the execution of a heat treatment. Viewed from the standpoint of shape uniformity and preventing the coalescence of the resin particles with each other, in the present invention this heat treatment is preferably a treatment using a hot air current.

A specific example of a method for executing a heat treatment on the resin particles using the heat treatment apparatus shown in FIG. 1 is given in the following.

The resin particles, which are metered and fed by a starting material metering and feed means 1, are conducted, by a compressed gas adjusted by a compressed gas flow rate adjustment means 2, to an introduction tube 3 that is disposed on the vertical line of a starting material feed means. The resin particles that have passed through the introduction tube 3 are uniformly dispersed by a conical projection member 4 that is disposed at the center of the starting material feed means and are introduced into an 8-direction feed tube 5 that extends radially and are introduced into a treatment compartment 6 in which the heat treatment is performed.

At this point, the flow of the resin particles fed into the treatment compartment 6 is regulated by a regulation means 9 that is disposed within the treatment compartment 6 in order to regulate the flow of the resin particles. As a result, the resin particles fed into the treatment compartment 6 are heat treated while rotating within the treatment compartment 6 and are thereafter cooled.

The hot air current for carrying out the heat treatment of the introduced resin particles is itself fed from a hot air current feed means 7 and is distributed by a distribution member 12, and the hot air current is introduced into the treatment compartment 6 having been caused to undergo a spiral rotation by a rotation member 13 for imparting rotation to the hot air current. With regard to its structure, the rotation member 13 for imparting rotation to the hot air current has a plurality of blades, and the rotation of the hot air current can be controlled using their number and angle (11 shows a hot air current feed means outlet). The hot air current fed into the treatment compartment 6 has a temperature at the outlet of the hot air current feed means 7 of preferably at least 100° C. and not more than 300° C. and more preferably at least 130° C. and not more than 170° C. When the temperature at the outlet of the hot air current feed means 7 resides in the indicated range, the resin particles can be uniformly treated while the melt adhesion and coalescence of the resin particles that would be induced by an excessive heating of the resin particles can be prevented.

A hot air current is fed from the hot air current feed means 7. In addition, the heat-treated resin particles that have been heat treated are cooled by a cold air current fed from a cold air current feed means 8. The temperature of the cold air current fed from the cold air current feed means 8 is preferably at least −20° C. and not more than 30° C. When the cold air current temperature resides in this range, the heat-treated resin particles can be efficiently cooled and melt adhesion and coalescence of the heat-treated resin particles can be prevented without impairing the uniform heat treatment of the resin particles. The absolute amount of moisture in the cold air current is preferably at least 0.5 $g/m^3$ and not more than 15.0 $g/m^3$. The cooled heat-treated resin particles are then recovered by a recovery means 10 residing at the lower end of the treatment compartment 6. A blower (not shown) is disposed at the end of the recovery means 10 and thereby forms a structure that carries out suction transport.

In addition, a powder particle feed port 14 is disposed so the rotational direction of the incoming resin particles is the same direction as the rotational direction of the hot air current, and the recovery means 10 is also disposed tangentially to the periphery of the treatment compartment 6 so as to maintain the rotational direction of the rotating resin particles. In addition, the cold air current fed from the cold air current feed means 8 is configured to be fed from a horizontal and tangential direction from the periphery of the apparatus to the circumferential surface within the treatment compartment. The rotational direction of the pre-heat-treatment resin particles fed from the powder particle feed port 14, the rotational direction of the cold air current fed from the cold air current feed means 8, and the rotational direction of the hot air current fed from the hot air current feed means 7 are all the same direction. As a consequence, flow perturbations within the treatment compartment 6 do not occur; the rotational flow within the apparatus is reinforced; a strong centrifugal force is applied to the resin particles prior to the heat treatment; and the dispersity of the resin particles prior to the heat treatment is further enhanced, as a result of which there are few coalesced particles and heat-treated resin particles with a uniform shape can be obtained. This is followed as necessary by the addition of an external additive, e.g., selected inorganic fine particles and so forth, to yield the toner.

The average circularity of the toner in the present invention is preferably at least 0.960 and not more than 1.000 and more preferably at least 0.965 and not more than 1.000. The transfer efficiency of the toner is increased by having the average circularity of the toner be in the indicated range.

The average circularity of the toner may be measured with an "FPIA-3000" (Sysmex Corporation), a flow-type particle image analyzer, using the measurement and analysis conditions from the calibration process.

The methods used to measure the properties related to the present invention are described in the following.

<Measurement of the Glass Transition Temperature (Tg) of the Resins>

The glass transition temperature of the resins is measured based on ASTM D 3418-82 using a "Q2000" differential scanning calorimeter (TA Instruments).

Temperature correction in the instrument detection section is performed using the melting points of indium and zinc, and the amount of heat is corrected using the heat of fusion of indium.

Specifically, approximately 5 mg of the resin is exactly weighed out and this is introduced into an aluminum pan; an empty aluminum pan is used for reference.

The measurement is run at a ramp rate of 10° C./minute in the measurement range between 30° C. and 180° C. The temperature is initially raised to 180° C. and held for 10 minutes, followed by cooling to 30° C. and then reheating. The change in the specific heat is obtained in the temperature range from 30° C. to 100° C. in the second ramp up process. The glass transition temperature (Tg) of the resin is taken to be the point at the intersection between the differential heat curve and the line for the midpoint for the baselines for prior to and subsequent to the appearance of the change in the specific heat.

<Measurement of the Peak Temperature of the Maximum Endothermic Peak for the Wax and Crystalline Polyester>

The peak temperature of the maximum endothermic peak is measured on the wax and crystalline polyester using the following conditions and a "Q2000" differential scanning calorimeter (TA Instruments).

ramp rate: 10° C./minute measurement start temperature: 20° C.

measurement end temperature: 180° C.

Temperature correction in the instrument detection section is performed using the melting points of indium and zinc, and the amount of heat is corrected using the heat of fusion of indium.

Specifically, approximately 5 mg of the sample is exactly weighed out and this is introduced into an aluminum pan and the measurement is performed one time. An empty aluminum pan is used for reference.

When a plurality of peaks are present, the maximum endothermic peak refers in the present invention to the peak presenting the largest endothermic quantity.

<Measurement of the Weight-Average Molecular Weight (Mw)>

The weight-average molecular weight is measured as follows using gel permeation chromatography (GPC).

First, the sample is dissolved in tetrahydrofuran (THF) over 24 hours at room temperature. The obtained solution is filtered across a "Sample Pretreatment Cartridge" solvent-resistant membrane filter with a pore diameter of 0.2 μm (Tosoh Corporation) to obtain the sample solution. The sample solution is adjusted to a THF-soluble component concentration of approximately 0.8 mass %. The measurement is performed under the following conditions using this sample solution.

instrument: HLC8120 GPC (detector: RI) (Tosoh Corporation)

columns: 7-column train of Shodex KF-801, 802, 803, 804, 805, 806, and 807 (Showa Denko K.K.)

eluent: tetrahydrofuran (THF)

flow rate: 1.0 mL/minute oven temperature: 40.0° C.

sample injection amount: 0.10 mL

A calibration curve constructed using polystyrene resin standards (product name: "TSK Standard Polystyrene F-850, F-450, F-288, F-128, F-80, F-40, F-20, F-10, F-4, F-2, F-1, A-5000, A-2500, A-1000, and A-500", Tosoh Corporation) is used to determine the molecular weight of the sample.

<Method for Measuring the Weight-Average Particle Diameter (D4) of, e.g., the Toner>

The weight-average particle diameter (D4) of the toner or resin particles (also referred to herebelow as, e.g., toner) is determined by performing measurement in 25,000 channels for the number of effective measurement channels and analyzing the measurement data using a "Coulter Counter Multisizer 3" (registered trademark, Beckman Coulter, Inc.), a precision particle size distribution measurement instrument operating on the pore electrical resistance method and equipped with a 100 μm aperture tube, and using the accompanying dedicated software, i.e., "Beckman Coulter Multisizer 3 Version 3.51" (Beckman Coulter, Inc.), to set the measurement conditions and analyze the measurement data.

The aqueous electrolyte solution used for the measurements is prepared by dissolving special-grade sodium chloride in deionized water to provide a concentration of approximately 1 mass % and, for example, "Isoton II" (Beckman Coulter, Inc.) can be used.

The dedicated software is configured as follows prior to measurement and analysis.

In the "modify the standard operating method (SOM)" screen in the dedicated software, the total count number in the control mode is set to 50,000 particles; the number of measurements is set to 1 time; and the Kd value is set to the value obtained using "standard particle 10.0 μm" (Beckman Coulter, Inc.). The threshold value and noise level are automatically set by pressing the threshold value/noise level measurement button. In addition, the current is set to 1600 μA; the gain is set to 2; the electrolyte is set to Isoton II; and a check is entered for the post-measurement aperture tube flush.

In the "setting conversion from pulses to particle diameter" screen of the dedicated software, the bin interval is set to logarithmic particle diameter; the particle diameter bin is set to 256 particle diameter bins; and the particle diameter range is set to at least 2 μm and not more than 60 μm.

The specific measurement procedure proceeds as follows.

(1) Approximately 200 mL of the above-described aqueous electrolyte solution is introduced into a 250-mL round-bottom glass beaker intended for use with the Multisizer 3 and this is placed in the sample stand and counterclockwise stirring with the stirrer rod is carried out at 24 rotations per second. Contamination and air bubbles within the aperture tube are removed using the "aperture flush" function of the dedicated software.

(2) Approximately 30 mL of the above-described aqueous electrolyte solution is introduced into a 100-mL flatbottom glass beaker. To this is added as dispersing agent approximately 0.3 mL of a dilution prepared by the three-fold (mass) dilution with deionized water of "Contaminon N" (a 10 mass % aqueous solution of a neutral pH 7 detergent for cleaning precision measurement instrumentation, comprising a nonionic surfactant, anionic surfactant, and organic builder, Wako Pure Chemical Industries, Ltd.).

(3) A prescribed amount of deionized water is introduced into the water tank of an "Ultrasonic Dispersion System Tetora 150" (Nikkaki Bios Co., Ltd.), which is an ultrasound disperser with an electrical output of 120 W and equipped with two oscillators (oscillation frequency=50 kHz) disposed such that the phases are displaced by 180°, and approximately 2 mL of Contaminon N is added to this water tank.

(4) The beaker described in (2) is set into the beaker holder opening on the ultrasound disperser and the ultrasound disperser is started. The vertical position of the beaker is adjusted in such a manner that the resonance condition of the surface of the aqueous electrolyte solution within the beaker is at a maximum.

(5) While the aqueous electrolyte solution within the beaker set up according to (4) is being irradiated with ultrasound, approximately 10 mg of, e.g., the toner, is added to the aqueous electrolyte solution in small aliquots and dispersion is carried out. The ultrasound dispersion treatment is continued for an additional 60 seconds. The water temperature in the water tank is adjusted as appropriate during ultrasound dispersion to be at least 10° C. and not more than 40° C.

(6) Using a pipette, the aqueous electrolyte solution prepared in (5), in which, e.g., toner, is dispersed, is dripped into the roundbottom beaker set in the sample stand as described in (1) with adjustment to provide a measurement concentration of approximately 5%. Measurement is then performed until the number of measured particles reaches 50,000.

(7) The measurement data is analyzed by the previously cited dedicated software provided with the instrument and the weight-average particle diameter (D4) is calculated. When set to graph/volume % with the dedicated software, the "average diameter" on the analysis/volumetric statistical value (arithmetic average) screen is the weight-average particle diameter (D4).

<Resin Structure (NMR)>

The structure of the resin (e.g., cyclic polyolefin resin, crystalline polyester) present in the toner is analyzed by nuclear magnetic resonance spectroscopic analysis ($^1$H-NMR).

measurement instrumentation: JNM-EX400 (JEOL Ltd.)
measurement frequency: 400 MHz
pulse condition: 5.0 μs
frequency range: 10500 Hz
number of integrations: 1024
measurement solvent: DMSO-d6

The sample is dissolved in the DMSO-d6 as much as possible and the measurement is performed under the conditions indicated above. The structure of the sample and so forth is determined from the chemical shift values and proton ratios in the resulting spectrum.

<Method for Surface Analysis of the Toner Particle>

The abundance ratio of oxygen atoms to carbon atoms [0/C] at the toner particle surface is analyzed by x-ray photoelectron spectroscopy (XPS) under the conditions given below using a PHI5000 VersaProbe II (ULVA-PHI, Inc.).

The measurement sample is prepared by fixing 1 mg of the toner on indium foil. Here, the toner is uniformly fixed so the indium foil is not exposed.

The abundance ratio of oxygen atoms to carbon atoms is calculated in the present invention as follows (formula 1) where O (atm %) is the amount of occurrence in the toner particle surface of oxygen atom deriving from the crystalline polyester and C (atm %) is the amount of occurrence in the toner particle surface of carbon atom deriving from cyclic polyolefin resin.

The element distribution at the top surface (several nm) of a substance can be measured by XPS.

abundance ratio of oxygen atoms to carbon atoms (%)=(O atm %/C atm %)×100 (formula 1):

(Measurement Conditions)

incident beam: Al Kd X-ray
output: 25 W, 15 kV
PassEnergy: 58.7 eV
Stepsize: 0.125 eV
XPS peaks (P2): $O_{1s}$, $C_{1s}$ <Method for Confirming the Coat Layer Using a Transmission Electron Microscope>

Whether the coat layer is present at the toner particle surface can be checked using a transmission electron microscope (TEM).

The cyclic polyolefin resin is obtained as a clear contrast by the execution of ruthenium tetroxide staining on the toner. The cyclic polyolefin resin stains more strongly than the carbonyl group-bearing amorphous resin. This is thought to be due to the following: due to interaction between the ruthenium tetroxide and the polyolefin moiety in the cyclic polyolefin resin, the infiltration of the staining material into the cyclic polyolefin resin is stronger than for the organic components in the interior of the toner particle.

The amount of the ruthenium atom varies as a function of the strength/weakness of staining, and as a result these atoms are present in large amounts in a strongly stained region and transmission of the electron beam then does not occur and black appears in the observed image. The electron beam is readily transmitted in weakly stained regions, which then appear in white on the observed image. The amorphous polyester can thereby be discriminated from the cyclic polyolefin resin and whether the coat layer is present at the toner particle surface can then be determined.

The specific procedure is as follows.

An Os film (5 nm) and a naphthalene film (20 nm) were coated for the toner as protective films using an osmium plasma coater (OPC80T, Filgen, Inc.), and embedding was performed with D800 photocurable resin (JEOL Ltd.). After this, toner cross sections with a film thickness of 60 nm were prepared using an ultrasound ultramicrotome (UC7, Leica Microsystems) and a slicing rate of 1 mm/sec.

Using a vacuum electronic staining device (VSC4R1H, Filgen, Inc.), the obtained cross sections were stained for 15 minutes in a 500 Pa $RuO_4$ gas atmosphere, and STEM observation was carried out using a TEM (JEM2800, JEOL Ltd.).

Acquisition was carried out at a STEM probe size of 1 nm and an image size of 1024×1024 pixels. Binarization (threshold value=120/255 gradations) was performed on the obtained images using "Image-Pro Plus (Media Cybernetics, Inc.)" image processing software.

Using the following formula and the toner cross section images obtained in these STEM observations, the coverage ratio by the coat layer with respect to the toner particle was calculated for 1000 toner particles and the average value was taken.

coverage ratio by the coat layer(%)=(length of the interface between the toner particle and the coat layer having a layer thickness of at least 0.1 μm)/(length of the toner particle circumference)×100

The layer thickness of the coat layer was also measured using the toner cross section images obtained in these STEM observations. The layer thickness is the thickness of the coat layer from the interface for the interior of the coat layer at the toner particle to the surface of the toner particle. For 100 toner particles, the thickness of the coat layer in each toner particle cross section was measured at 10 randomly selected points, and the average value thereof was taken to be the average layer thickness of the coat layer.

By proceeding in the described manner, whether the coat layer is present at the toner particle surface can be confirmed using the toner cross section images obtained by TEM.

In addition, the crystalline polyester, because it lacks the polyolefin moiety, stains more weakly than the cyclic polyolefin resin. Thus, when a crystalline polyester is present in the toner, the crystalline polyester and cyclic polyolefin resin can be discriminated based on the contrast difference.

<Method for Measuring the Softening Point (Tm)>

The softening point of, e.g., the resin, was measured using a constant-load extrusion-type capillary rheometer, i.e., a "Flowtester CFT-500D Flow Property Evaluation Instrument" (Shimadzu Corporation), in accordance with the manual provided with the instrument.

With this instrument, the measurement sample filled in a cylinder is heated and melted while a constant load is applied by a piston from the top of the measurement sample; the melted measurement sample is extruded from a die at the bottom of the cylinder; and a flow curve showing the relationship between piston stroke and temperature is obtained from this.

The "melting temperature by the ½ method", as described in the manual provided with the "Flowtester CFT-500D Flow Property Evaluation Instrument", is used as the softening point in the present invention.

The melting temperature by the ½ method is determined as follows.

First, ½ of the difference between Smax, which is the piston stroke at the completion of outflow, and Smin, which is the piston stroke at the start of outflow, is determined (this value is designated as X, where X=(Smax−Smin)/2). The temperature of the flow curve when the piston stroke in the flow curve reaches the sum of X and Smin is the melting temperature by the ½ method.

The measurement sample used is prepared by subjecting approximately 1.0 g of the resin to compression molding for approximately 60 seconds at approximately 10 MPa in a 25° C. environment using a tablet compression molder (for example, the NT-100H, NPa System Co., Ltd.) to provide a cylindrical shape with a diameter of approximately 8 mm.

The measurement conditions with the CFT-500D are as follows.

test mode: rising temperature method
start temperature: 50° C.
saturated temperature: 200° C.
measurement interval: 1.0° C.
ramp rate: 4.0° C./minute
piston cross section area: 1.000 $cm^2$
test load (piston load): 10.0 kgf (0.9807 MPa)
preheating time: 300 seconds
diameter of die orifice: 1.0 mm
die length: 1.0 mm

EXAMPLES

The present invention is more specifically described herebelow using production examples and examples; however, the present invention is in no way limited to or by these. Unless specifically indicated otherwise, the number of parts and % in the following blends is on a mass basis in all instances.

Amorphous Resin A Production Example polyoxypropylene(2.2)-2,2-bis(4-hydroxyphenyl)propane: 71.9 parts (0.20 mol, 100.0 mol % with respect to the total number of moles of polyhydric alcohol)
terephthalic acid: 26.8 parts (0.16 mol, 96.0 mol % with respect to the total number of moles of polybasic carboxylic acid)
titanium tetrabutoxide: 0.5 parts These materials were weighed into a reaction vessel fitted with a condenser, stirrer, nitrogen introduction line, and thermocouple. The interior of the reaction vessel was then substituted with nitrogen gas; the temperature was subsequently gradually raised while stirring; and a reaction was run for 4 hours while stirring at 200° C.

The pressure within the reaction vessel was dropped to 8.3 kPa and, after holding for 1 hour, return to atmospheric pressure was performed (first reaction step).

trimellitic anhydride: 1.3 parts (0.01 mol, 4.0 mol % with respect to the total number of moles of polybasic carboxylic acid)

This material was then added; the pressure within the reaction vessel was dropped to 8.3 kPa; holding was carried out in this condition at a temperature of 180° C.; and a reaction was run for 1 hour (second reaction step) to obtain an amorphous polyester resin A having a softening point (Tm) of 94° C. and a glass transition temperature (Tg) of 57° C.

Amorphous Resin B Production Example polyoxypropylene(2.2)-2,2-bis(4-hydroxyphenyl)propane: 71.8 parts (0.20 mol, 100.0 mol % with respect to the total number of moles of polyhydric alcohol)
terephthalic acid: 15.0 parts (0.09 mol, 55.0 mol % with respect to the total number of moles of polybasic carboxylic acid)
adipic acid: 6.0 parts (0.04 mol, 25.0 mol % with respect to the total number of moles of polybasic carboxylic acid)
titanium tetrabutoxide: 0.5 parts These materials were weighed into a reaction vessel fitted with a condenser, stirrer, nitrogen introduction line, and thermocouple. The interior of the reaction vessel was then substituted with nitrogen gas; the temperature was subsequently gradually raised while stirring; and a reaction was run for 2 hours while stirring at 200° C.

The pressure within the reaction vessel was dropped to 8.3 kPa and, after holding for 1 hour, return to atmospheric pressure was performed (first reaction step).

trimellitic anhydride: 6.4 parts (0.03 mol, 20.0 mol % with respect to the total number of moles of polybasic carboxylic acid)

This material was then added; the pressure within the reaction vessel was dropped to 8.3 kPa; holding was carried out in this condition at a temperature of 160° C.; and a reaction was run for 15 hours (second reaction step) to obtain an amorphous polyester resin B having a softening point (Tm) of 132° C. and a glass transition temperature (Tg) of 61° C.

Amorphous Resin C Production Example 50 parts of xylene was introduced into an autoclave and, after substitution with nitrogen, the temperature was raised to 185° C. while sealed and with stirring.

Polymerization was carried out by the continuous dropwise addition over 3 hours of a mixed solution of 95 parts of styrene, 5 parts of n-butyl acrylate, 5 parts of di-t-butyl peroxide, and 20 parts of xylene while controlling the temperature within the autoclave to 185° C.

The polymerization was finished by holding for 1 hour at the same temperature and the solvent was removed to obtain a styrene-acrylate ester resin C.

The obtained styrene-acrylate ester resin C had a weight-average molecular weight (Mw) of 3500, a softening point (Tm) of 96° C., and a glass transition temperature (Tg) of 58° C.

Polyolefin Resin Particle D1 Production Example

A three-neck flask was substituted with ethylene at room temperature and 100 parts of norbornene and 120 parts of toluene were subsequently added. The solution was then saturated with ethylene by the additional introduction of ethylene with pressurization several times ($3.0\times10^5$ Pa).

After establishing the pressure at $3.0\times10^5$ Pa (gauge pressure), a toluene solution of 0.1 parts of methylaluminoxane dissolved in 1.0 part of toluene was added dropwise to the reactor and the mixture was stirred for 15 minutes at 70° C.

Proceeding in parallel, a two-neck flask was substituted with nitrogen at room temperature followed by the addition and dissolution of 0.1 parts of methylaluminoxane in 1.0 part of toluene. 0.3 parts of isopropylene(1-indenyl)cyclopentadienylzirconium dichloride was added to the resulting toluene solution and a preliminary activation was performed by standing for 30 minutes. The solution of the preliminarily activated complex was added dropwise to the aforementioned norbornene reaction solution.

A reaction product was obtained by stirring the mixture for 1 hour at 70° C., during which time the ethylene pressure was held at $3.0\times10^5$ Pa by additionally introducing metered ethylene. The resulting reaction product was gradually added dropwise into 1000 parts of acetone followed by stirring for 10 minutes and then separation of the precipitate by filtration. The filter cake was washed several times in alternation with hydrochloric acid with a concentration of 10% and acetone, followed by washing the cake with deionized water to neutrality to obtain a polymer.

The obtained polymer was separated by filtration and dried for 20 hours at a temperature of 80° C. and a pressure of $0.2\times10^5$ Pa to obtain a polyolefin resin.

A solution was prepared by dissolving 10 parts of the obtained polyolefin resin in 30 parts of toluene. Proceeding in parallel, a solution was prepared by dissolving 0.4 parts of a nonionic surfactant in 40 parts of deionized water. While stirring with a T.K. Homomixer from PRIMIX Corporation, the toluene solution of the polyolefin resin was added dropwise at room temperature to the prepared aqueous surfactant solution. This was followed by continuing to stir for 1 hour at room temperature to prepare an emulsion.

The obtained emulsion was gradually added dropwise at room temperature to 300 parts of methanol and stirring was carried out for 20 minutes using a Three-One Motor (propeller blade).

The precipitated resin particles were separated by filtration and washed 4 times with 30 parts of deionized water. The obtained resin particles were dried for 20 hours at a temperature of 80° C. and a pressure of $0.2\times10^5$ Pa to obtain a polyolefin resin particle D1. The properties of D1 and the like are given in Table 1.

Polyolefin Resin Particles D2 to D9 Production Example

Polyolefin resin particles D2 to D9 were obtained using the same procedure as in the Polyolefin Resin Particle D1 Production Example, but changing the type of the ethylene, α-olefin, and cyclic olefin and conditions in the Polyolefin Resin Particle D1 Production Example as appropriate for providing the properties in Table 1.

TABLE 1

| poly-olefin resin | ethylene or α-olefin | cyclic olefin | particle diameter (nm) | glass transition temperature (° C.) |
|---|---|---|---|---|
| D1 | ethylene | norbornene | 100 | 75 |
| D2 | 1-propene | isobornene | 110 | 85 |
| D3 | 1-butene | tetracyclododecene | 90 | 80 |
| D4 | 1-pentene | dicyclopentadiene | 120 | 78 |
| D5 | 1-hexene | cyclohexene | 130 | 83 |
| D6 | 1-dodecene | cyclopentene | 100 | 70 |
| D7 | — | cyclobutene | 110 | 95 |
| D8 | — | cyclopropene | 110 | 90 |
| D9 | ethylene | — | 110 | −50 |

Crystalline Polyester E1 Production Example 1,6-hexanediol: 34.5 parts (0.29 mol; 100.0 mol % with respect to the total number of moles of the polyhydric alcohol)

dodecanedioic acid: 65.5 parts (0.29 mol; 100.0 mol % with respect to the total number of moles of the polybasic carboxylic acid)

tin 2-ethylhexanoate: 0.5 parts

These materials were weighed into a reaction vessel fitted with a condenser, stirrer, nitrogen introduction line, and thermocouple. The interior of the reaction vessel was then substituted with nitrogen gas; the temperature was subsequently gradually raised while stirring; and a reaction was run for 3 hours while stirring at 140° C.

In addition, the pressure within the reaction vessel was dropped to 8.3 kPa; holding was carried out in this condition at a temperature of 200° C.; and a reaction was run for 4 hours.

The pressure within the reaction vessel was then reduced to 5 kPa or below and a reaction was run for 3 hours at 200° C. to obtain a crystalline polyester E1.

Crystalline Polyesters E2 to E11 Production Example

Crystalline polyesters E2 to E11 were obtained by carrying out the same procedure as in the Crystalline Polyester E1 Production Example, but changing the conditions in the Crystalline Polyester E1 Production Example as appropriate to provide the diol and dicarboxylic acid shown in Table 2.

TABLE 2

| crystalline polyester | diol | dicarboxylic acid |
|---|---|---|
| E1 | 1,6-hexanediol (C6) | dodecanedioic acid (C12) |
| E2 | 1,12-dodecanediol (C12) | hexanedioic acid (C6) |
| E3 | 1,10-decanediol (C10) | hexanedioic acid (C6) |
| E4 | 1,6-hexanediol (C6) | decanedioic acid (C10) |
| E5 | 1,12-dodecanediol (C12) | decanedioic acid (C10) |
| E6 | 1,6-hexanediol (C6) | hexadecanedioic acid (C16) |
| E7 | 1,4-butanediol (C4) | octadecanedioic acid (C18) |
| E8 | 1,18-octadecanediol (C18) | butanedioic acid (C4) |
| E9 | 1,4-butanediol (C4) | butanedioic acid (C4) |
| E10 | 1,18-octadecanediol (C18) | octadecanedioic acid (C18) |
| E11 | 1,4-butanediol (C4) | decanedioic acid (C10) |

Toner 1 Production Example: Melt-Kneading Method Including a Heat Treatment Step

| | |
|---|---|
| amorphous resin A | 75.0 parts |
| amorphous resin B | 25.0 parts |
| crystalline polyester E1 | 7.5 parts |
| hydrocarbon wax | 5.0 parts |
| (peak temperature (melting point) of the maximum endothermic peak = 90° C.) | |
| C.I. Pigment Blue 15:3 | 7.0 parts |
| aluminum 3,5-di-t-butylsalicylate compound | 0.3 parts |

Using a Henschel mixer (Model FM-75, Nippon Coke & Engineering Co., Ltd.), these materials were mixed at a rotation rate of 20 $s^{-1}$ for a mixing time of 5 minutes followed by kneading with a twin-screw kneader (Model PCM-30, Ikegai Corp) set to a temperature of 150° C.

The obtained kneaded material was cooled and was coarsely pulverized with a hammer mill to 1 mm and below to obtain a coarsely pulverized material.

The obtained coarsely pulverized material was finely pulverized with a mechanical pulverizer (T-250, Turbo Kogyo Co., Ltd.). Classification was additionally performed using a Faculty F-300 (Hosokawa Micron Corporation) to obtain a toner particle 1. The following operating conditions were used: a classification rotor rotation rate of 130 $s^{-1}$ and a dispersion rotor rotation rate of 120 $s^{-1}$.

4.5 parts of polyolefin resin particle D1 was added to 100 parts of the obtained toner particle 1 and mixing was carried out using a Henschel mixer (Model FM-75, Nippon Coke & Engineering Co., Ltd.) at a rotation rate of 30 $s^{-1}$ for a rotation time of 10 minutes.

A heat treatment was performed on the resulting resin particles using the heat treatment apparatus shown in FIG. 1 to obtain a heat-treated resin particle 1. The operating conditions for the heat treatment apparatus were as follows: feed rate=5 kg/hr; hot air current temperature=150° C.; hot air current flow rate=6 $m^3$/minute; cold air current temperature=5° C.; cold air current flow rate=4 $m^3$/minute; absolute amount of moisture in the cold air current=3 g/$m^3$; blower output=20 $m^3$/minute; injection air flow rate=1 $m^3$/minute. The obtained heat-treated resin particle 1 had a weight-average particle diameter (D4) of 6.4 μm.

To 100 parts of the obtained heat-treated resin particle 1 were added 1.0 part of titanium oxide fine particles (BET: 80 $m^2$/g) that had been surface-treated with isobutyltrimethoxysilane and 1.0 part of a hydrophobic silica (BET: 200 $m^2$/g) and mixing was carried out with a Henschel mixer (Model FM-75, Nippon Coke & Engineering Co., Ltd.) at a rotation rate of 30 $s^{-1}$ for a rotation time of 10 minutes to obtain a toner 1. An endothermic peak deriving from the crystalline polyester was observed in differential scanning calorimetric measurement on the obtained toner 1. The weight-average particle diameter (D4) of the toner was 6.4 μm. The formation at the toner particle surface of a coat layer containing the cyclic polyolefin resin was confirmed for toner 1 by TEM observation. The properties of the toner are given in Table 3.

Toner 2 Production Example: Melt-Kneading Method

A toner particle 2 was obtained by the same production method as for toner particle 1 in the Toner 1 Production Example.

4.5 parts of polyolefin resin particle D1 was added to 100 parts of the obtained toner particle 2 and this was introduced into a Nobilta (Hosokawa Micron Corporation) and mixing was carried out at a rotation rate of 150 $s^{-2}$ for a rotation time of 10 minutes to obtain a resin particle 2 in which the surface of toner particle 2 was coated with the polyolefin resin particle D1.

To 100 parts of the obtained resin particle 2 were added 1.0 part of titanium oxide fine particles (BET: 80 $m^2$/g) that had been surface-treated with isobutyltrimethoxysilane and 1.0 part of a hydrophobic silica (BET: 200 $m^2$/g) and mixing was carried out with a Henschel mixer (Model FM-75, Nippon Coke & Engineering Co., Ltd.) at a rotation rate of 30 $s^{-1}$ for a rotation time of 10 minutes to obtain a toner 2. An endothermic peak deriving from the crystalline polyester was observed in differential scanning calorimetric measurement on the obtained toner 2. The formation at the toner particle surface of a coat layer containing the cyclic polyolefin resin was confirmed for toner 2 by TEM observation. The properties of the toner are given in Table 3.

Toner 3 Production Example: Melt-Kneading Method

A toner particle 3 was obtained by the same production method as for toner particle 1 in the Toner 1 Production Example.

4.5 parts of polyolefin resin particle D1 was added to 100 parts of the obtained toner particle 3 and this was introduced into a Mechano Hybrid (Nippon Coke & Engineering Co., Ltd.) and mixing was carried out at a rotation rate of 160 $s^{-1}$ for a rotation time of 5 minutes to obtain a resin particle 3 in which the surface of toner particle 3 was coated with the polyolefin resin particle D1.

To 100 parts of the obtained resin particle 3 were added 1.0 part of titanium oxide fine particles (BET: 80 $m^2$/g) that had been surface-treated with isobutyltrimethoxysilane and 1.0 part of a hydrophobic silica (BET: 200 $m^2$/g) and mixing was carried out with a Henschel mixer (Model FM-75, Nippon Coke & Engineering Co., Ltd.) at a rotation rate of 30 $s^{-1}$ for a rotation time of 10 minutes to obtain a toner 3. An endothermic peak deriving from the crystalline polyester was observed in differential scanning calorimetric measurement on the obtained toner 3. The formation at the toner particle surface of a coat layer containing the cyclic polyolefin resin was confirmed for toner 3 by TEM observation. The properties of the toner are given in Table 3.

Toner 4 Production Example: Melt-Kneading Method (Production of a Polyolefin Resin Dispersion)

A polyolefin resin D1 solution was obtained by dissolving 100 parts of polyolefin resin D1 in a mixed solvent of 200 parts of toluene and 100 parts of isopropyl alcohol.

While stirring the prepared polyolefin resin D1 solution with a T.K. Homomixer from PRIMIX Corporation at room temperature, 14 parts of a 10% aqueous ammonia solution was added dropwise over a dropwise addition time of 5 minutes and mixing was performed for 10 minutes.

An emulsion was obtained by inducing phase inversion by the dropwise addition of 900 parts of deionized water at a rate of 7 parts per minute. 800 parts of the obtained emulsion and 700 parts of deionized water were immediately introduced into a 2-L pear-shaped evaporating flask and this was set into an evaporator fitted with a vacuum control unit across an interposed bump trap.

The organic solvent was removed while rotating the pear-shaped evaporating flask and taking care to avoid bumping, and a dispersion was then obtained by ice cooling of the pear-shaped evaporating flask. A polyolefin resin D1 dispersion was obtained by adding deionized water to bring the solids concentration to 20%.

A toner particle 4 was obtained by the same method as in the Toner 1 Production Example, but using crystalline polyester E2 in place of crystalline polyester E1 and changing its amount of use from 7.5 parts to 6.0 parts in the Toner 1 Production Example.

100 parts of the obtained toner particle 4 was circulated at a feed air temperature of 80° C. in the fluidized bed of a Model SFP-01 particle coating apparatus (Powrex Corporation). 22.5 parts of the polyolefin resin D1 dispersion was then sprayed into the fluidized bed of the Model SFP-01 particle coating apparatus (Powrex Corporation) over 60 minutes at a spraying rate of 0.4 parts/minute and a resin particle 4 was thereby obtained.

To 100 parts of the obtained resin particle 4 were added 1.0 part of titanium oxide fine particles (BET: 80 $m^2/g$) that had been surface-treated with isobutyltrimethoxysilane and 1.0 part of a hydrophobic silica (BET: 200 $m^2/g$) and mixing was carried out with a Henschel mixer (Model FM-75, Nippon Coke & Engineering Co., Ltd.) at a rotation rate of 30 $s^{-1}$ for a rotation time of 10 minutes to obtain a toner 4. An endothermic peak deriving from the crystalline polyester was observed in differential scanning calorimetric measurement on the obtained toner 4. The formation at the toner particle surface of a coat layer containing the cyclic polyolefin resin was confirmed for toner 4 by TEM observation. The properties of the toner are given in Table 3.

<Toner 5 Production Method: Emulsion Aggregation Production Method>

(Production of Amorphous Polyester Resin Dispersions)

An amorphous polyester resin A dispersion and an amorphous polyester resin B dispersion (solids concentration: 20%) were obtained using amorphous polyester resins A and B, respectively, at a composition ratio of 80% deionized water and 20% amorphous polyester resin with adjustment of the pH to 8.5 using ammonia and processing with a Cavitron using 100° C. for the heating conditions.

(Production of a Polyolefin Resin Dispersion)

A polyolefin resin D1 solution was obtained by dissolving 100 parts of polyolefin resin D1 in a mixed solvent of 200 parts of toluene and 100 parts of isopropyl alcohol.

While stirring the prepared polyolefin resin D1 solution with a T.K. Homomixer from PRIMIX Corporation at room temperature, 14 parts of a 10% aqueous ammonia solution was added dropwise over a dropwise addition time of 5 minutes and mixing was performed for 10 minutes.

An emulsion was obtained by inducing phase inversion by the dropwise addition of 900 parts of deionized water at a rate of 7 parts per minute. 800 parts of the obtained emulsion and 700 parts of deionized water were immediately introduced into a 2-L pear-shaped evaporating flask and this was set into an evaporator equipped with a vacuum control unit across an interposed bump trap.

The organic solvent was removed while rotating the pear-shaped evaporating flask and taking care to avoid bumping, and a dispersion was then obtained by ice cooling of the pear-shaped evaporating flask. A polyolefin resin D1 dispersion was obtained by adding deionized water to bring the solids concentration to 20%.

(Production of a Crystalline Polyester Dispersion)

80 parts of crystalline polyester E3 and 720 parts of deionized water were introduced into a stainless steel beaker and heated to 100° C. Stirring with a homogenizer was started at the point at which the crystalline polyester E3 melted. 2.0 parts of an anionic surfactant (solids concentration: 20%) was then added dropwise, during which emulsification and dispersion were carried out to obtain a crystalline polyester E3 dispersion (solids concentration: 10%).

(Production of a Colorant Dispersion)

| | |
|---|---|
| C.I. Pigment Blue 15:3 | 1000 parts |
| anionic surfactant | 150 parts |
| deionized water | 9000 parts |

The preceding were mixed and the colorant was then dispersed using a high-pressure impact-type disperser.

The 50% particle diameter on a volume basis (d50) of the colorant particles in the obtained colorant dispersion was 0.16 μm, and the colorant concentration was 23%.

(Production of a Wax Dispersion)

| | |
|---|---|
| hydrocarbon wax (peak temperature (melting point) of the maximum endothermic peak = 90° C.) | 45 parts |
| anionic surfactant | 5 parts |
| deionized water | 150 parts |

These were heated to 95° C. and dispersion was carried out using a homogenizer followed by dispersion processing using a Gaulin Homogenizer pressure ejection disperser to prepare a wax dispersion (wax concentration: 20%) having a 50% particle diameter on a volume basis (d50) of 210 nm.

| | |
|---|---|
| amorphous polyester resin A dispersion | 375 parts |
| amorphous polyester resin B dispersion | 125 parts |
| crystalline polyester E3 dispersion | 50 parts |

These were mixed and dispersed in a roundbottom stainless steel flask using a homogenizer. 0.15 parts of polyaluminum chloride was added thereto and the dispersion processing was continued with an Ultra-Turrax. Then,

| | |
|---|---|
| colorant dispersion | 30.5 parts |
| wax dispersion | 25 parts |

were additionally added; 0.05 parts of polyaluminum chloride was further added; and dispersion processing with the Ultra-Turrax was continued.

A stirrer and a mantle heater were then installed, and, while adjusting the rotation rate of the stirrer so as to provide thorough stirring of the slurry, the temperature was raised to 60° C. and holding was performed for 15 minutes at 60° C.

Then, while raising the temperature at 0.05° C./minute, the particle diameter was measured every minutes using a Coulter Multisizer III (aperture diameter: 50 μm, Beckman Coulter, Inc.). When the 50% particle diameter on a volume basis (d50) reached 5.0 μm, 22.5 parts of the polyolefin resin D1 dispersion (supplemental resin addition) was added over 3 minutes. After holding for 30 minutes after this addition, the pH was brought to 9.0 using a 5% aqueous sodium hydroxide solution.

Then, while adjusting the pH to 9.0 every 5° C., the temperature was raised to 96° C. at a ramp rate of 1° C./minute and holding at 96° C. was carried out.

The particle shape and surface properties were observed every 30 minutes using an optical microscope and a scanning electron microscope (FE-SEM), and, after spheronization had been achieved at the fifth hour, the resin particles were solidified by cooling to 20° C. at 1° C./minute.

The product was then filtered, thoroughly washed with deionized water, and dried using a vacuum dryer to obtain toner particle 5.

To 100 parts of toner particle 5 were added 1.0 part of titanium oxide fine particles (BET: 80 $m^2/g$) that had been surface-treated with isobutyltrimethoxysilane and 1.0 part of a hydrophobic silica (BET: 200 $m^2/g$) and mixing was carried out with a Henschel mixer (Model FM-75, Nippon Coke & Engineering Co., Ltd.) at a rotation rate of 30 $s^{-1}$ for a rotation time of 10 minutes to obtain a toner 5. An endothermic peak deriving from the crystalline polyester was observed in differential scanning calorimetric measurement on the obtained toner 5. The formation at the toner particle surface of a coat layer containing the cyclic polyolefin resin was confirmed for toner 5 by TEM observation. The properties of the toner are given in Table 3.

Toners 6 to 9 Production Example

Toners 6 to 9 were obtained by carrying out the same procedure as in the Toner 5 Production Example, but changing the conditions in the Toner 5 Production Example as appropriate so as to provide the crystalline polyester type and content and the polyolefin resin content given in Table 3.

An endothermic peak deriving from the crystalline polyester was observed in differential scanning calorimetric measurement on the obtained toners 6 to 9. The formation at the toner particle surface of a coat layer containing the cyclic polyolefin resin was confirmed for each of toners 6 to 9 by TEM observation. The properties of the toners are given in Table 3.

Toners 10 to 16 Production Example

Toners 10 to 16 were obtained by carrying out the same procedure as in the Toner 5 Production Example, but changing the conditions in the Toner 5 Production Example as appropriate so as to provide the crystalline polyester type and content and the polyolefin resin type and content given in Table 3.

An endothermic peak deriving from the crystalline polyester was observed in differential scanning calorimetric measurement on the obtained toners 10 to 16. The formation at the toner particle surface of a coat layer containing the cyclic polyolefin resin was confirmed for each of toners 10 to 16 by TEM observation. The properties of the toners are given in Table 3.

Toner 17 Production Example

Toner 17 was obtained by carrying out the same procedure as in the Toner 5 Production Example, but changing the conditions in the Toner 5 Production Example as appropriate so as to provide the amorphous resin type, crystalline polyester type and content, and polyolefin resin type and content given in Table 3.

An endothermic peak deriving from the crystalline polyester was observed in differential scanning calorimetric measurement on the obtained toner 17. The formation at the toner particle surface of a coat layer containing the cyclic polyolefin resin was confirmed for toner 17 by TEM observation. The properties of the toner are given in Table 3.

Toners 18 and 19 Production Example

Toners 18 and 19 were obtained by carrying out the same procedure as in the Toner 17 Production Example, but changing the Toner 17 Production Example so as to provide the wax type given in Table 3.

An endothermic peak deriving from the crystalline polyester was observed in differential scanning calorimetric measurement on the obtained toners 18 and 19. The formation at the toner particle surface of a coat layer containing the cyclic polyolefin resin was confirmed for each of toners 18 and 19 by TEM observation. The properties of the toners are given in Table 3.

Toner 20 Production Example

Toner 20 was obtained by carrying out the same procedure as in the Toner 1 Production Example, but changing the Toner 1 Production Example so as to provide the polyolefin resin type given in Table 3.

An endothermic peak deriving from the crystalline polyester was observed in differential scanning calorimetric measurement on the obtained toner 20. The formation at the toner particle surface of a coat layer containing the polyolefin resin was confirmed for toner 20 by TEM observation. The properties of the toner are given in Table 3.

Toner 21 Production Example

Toner 21 was obtained by carrying out the same procedure as in the Toner 1 Production Example, but changing the Toner 1 Production Example so as to provide the amount of addition given in Table 3 for the cyclic polyolefin resin.

An endothermic peak deriving from the crystalline polyester was observed in differential scanning calorimetric measurement on the obtained toner 21. It was confirmed that a coat layer containing the cyclic polyolefin resin was not formed at the toner particle surface for toner 21 by TEM observation. The properties of the toner are given in Table 3.

Toner 22 Production Example (Production of Amorphous Polyester Resin Dispersions)

An amorphous polyester resin A dispersion and an amorphous polyester resin B dispersion (solids concentration: 20%) were obtained using amorphous polyester resins A and B, respectively, at a composition ratio of 80% deionized water and 20% amorphous polyester resin with adjustment of the pH to 8.5 using ammonia and processing with a Cavitron using 100° C. for the heating conditions.

(Production of a Polyolefin Resin Dispersion)

A polyolefin resin D1 solution was obtained by dissolving 100 parts of polyolefin resin D1 in a mixed solvent of 200 parts of toluene and 100 parts of isopropyl alcohol.

While stirring the prepared polyolefin resin D1 solution with a T.K. Homomixer from PRIMIX Corporation at room temperature, 14 parts of a 10% aqueous ammonia solution was added dropwise over a dropwise addition time of 5 minutes and mixing was performed for 10 minutes.

An emulsion was obtained by inducing phase inversion by the dropwise addition of 900 parts of deionized water at a rate of 7 parts per minute. 800 parts of the obtained emulsion and 700 parts of deionized water were immediately introduced into a 2-L pear-shaped evaporating flask and this was set into an evaporator equipped with a vacuum control unit across an interposed bump trap.

The organic solvent was removed while rotating the pear-shaped evaporating flask and taking care to avoid bumping, and a dispersion was then obtained by ice cooling of the pear-shaped evaporating flask. A polyolefin resin D1 dispersion was obtained by adding deionized water to bring the solids concentration to 20%.

(Production of a Crystalline Polyester Dispersion)

80 parts of crystalline polyester E11 and 720 parts of deionized water were introduced into a stainless steel beaker and heated to 100° C. Stirring with a homogenizer was started at the point at which the crystalline polyester E11 melted. 2.0 parts of an anionic surfactant (solids concentration: 20%) was than added dropwise, during which emulsification and dispersion were carried out to obtain a crystalline polyester E11 dispersion (solids concentration: 10%).

(Production of a Colorant Dispersion)

| | |
|---|---|
| C.I. Pigment Blue 15:3 | 1000 parts |
| anionic surfactant | 150 parts |
| deionized water | 9000 parts |

The preceding were mixed and the colorant was then dispersed using a high-pressure impact-type disperser.

The 50% particle diameter on a volume basis (d50) of the colorant particles in the obtained colorant dispersion was 0.16 μm, and the colorant concentration was 23%.

(Production of a Wax Dispersion)

| | |
|---|---|
| hydrocarbon wax (peak temperature (melting point) of the maximum endothermic peak = 70° C.) | 45 parts |
| anionic surfactant | 5 parts |
| deionized water | 150 parts |

These were heated to 95° C. and dispersion was carried out using a homogenizer followed by dispersion processing using a Gaulin Homogenizer pressure ejection disperser to prepare a wax dispersion (wax concentration: 20%) having a 50% particle diameter on a volume basis (d50) of 210 nm.

| | |
|---|---|
| polyolefin resin D1 dispersion | 500 parts |
| crystalline polyester E11 dispersion | 200 parts |

These were mixed and dispersed in a roundbottom stainless steel flask using a homogenizer. 0.15 parts of polyaluminum chloride was added thereto and the dispersion processing was continued with an Ultra-Turrax. Then

| | |
|---|---|
| colorant dispersion | 30.5 parts |
| wax dispersion | 25 parts |

were additionally added; 0.05 parts of polyaluminum chloride was further added; and dispersion processing with the Ultra-Turrax was continued.

A stirrer and a mantle heater were then installed, and, while adjusting the rotation rate of the stirrer so as to provide thorough stirring of the slurry, the temperature was raised to 60° C. and holding was performed for 15 minutes at 60° C.

Then, while raising the temperature at 0.05° C./minute, the particle diameter was measured every minutes using a Coulter Multisizer III (aperture diameter: 50 μm, Beckman Coulter, Inc.). When the 50% particle diameter on a volume basis (d50) reached 5.0 μm, 16.5 parts of the amorphous polyester resin A dispersion and 6.0 parts of the amorphous polyester resin B dispersion were added over 3 minutes. After holding for 30 minutes after this addition, the pH was brought to 9.0 using a 5% aqueous sodium hydroxide solution.

Then, while adjusting the pH to 9.0 every 5° C., the temperature was raised to 96° C. at a ramp rate of 1° C./minute and holding at 96° C. was carried out.

The particle shape and surface properties were observed every 30 minutes using an optical microscope and a scanning electron microscope (FE-SEM), and, after spheronization had been achieved at the fifth hour, the resin particles were solidified by cooling to 20° C. at 1° C./minute.

The product was then filtered, thoroughly washed with deionized water, and dried using a vacuum dryer to obtain toner particle 22.

To 100 parts of toner particle 22 were added 1.0 part of titanium oxide fine particles (BET: 80 $m^2/g$) that had been surface-treated with isobutyltrimethoxysilane and 1.0 part of a hydrophobic silica (BET: 200 $m^2/g$) and mixing was carried out with a Henschel mixer (Model FM-75, Nippon Coke & Engineering Co., Ltd.) at a rotation rate of 30 $s^{-1}$ for a rotation time of 10 minutes to obtain a toner 22. An endothermic peak deriving from the crystalline polyester was observed in differential scanning calorimetric measurement on the obtained toner 22. The formation at the toner particle surface of a coat layer containing the amorphous polyester resin was confirmed for toner 22 by TEM observation. The properties of the toner are given in Table 3.

TABLE 3

| | formulation | | | | | | | | | |
|---|---|---|---|---|---|---|---|---|---|---|
| | amorphous resin | | | polyolefin resin | | crystalline polyester | | wax | | |
| toner No. | resin A (parts) | resin B (parts) | resin C (parts) | type | content (parts) | type | content (parts) | type | melting point (° C.) | content (parts) |
| 1 | 75.0 | 25.0 | — | D1 | 4.5 | E1 | 7.5 | W1 | 90 | 5.0 |
| 2 | 75.0 | 25.0 | — | D1 | 4.5 | E1 | 7.5 | W1 | 90 | 5.0 |
| 3 | 75.0 | 25.0 | — | D1 | 4.5 | E1 | 7.5 | W1 | 90 | 5.0 |
| 4 | 75.0 | 25.0 | — | D1 | 4.5 | E2 | 6.0 | W1 | 90 | 5.0 |
| 5 | 75.0 | 25.0 | — | D1 | 4.5 | E3 | 5.0 | W1 | 90 | 5.0 |
| 6 | 75.0 | 25.0 | — | D1 | 4.0 | E3 | 3.0 | W1 | 90 | 5.0 |
| 7 | 75.0 | 25.0 | — | D1 | 4.0 | E4 | 10.0 | W1 | 90 | 5.0 |
| 8 | 75.0 | 25.0 | — | D1 | 4.0 | E4 | 1.0 | W1 | 90 | 5.0 |
| 9 | 75.0 | 25.0 | — | D1 | 5.0 | E5 | 15.0 | W1 | 90 | 5.0 |
| 10 | 75.0 | 25.0 | — | D2 | 7.0 | E6 | 25.0 | W1 | 90 | 5.0 |
| 11 | 75.0 | 25.0 | — | D3 | 9.0 | E7 | 20.0 | W1 | 90 | 5.0 |

TABLE 3-continued

| | | | | | | | | | | |
|---|---|---|---|---|---|---|---|---|---|---|
| 12 | 75.0 | 25.0 | — | D4 | 3.0 | E8 | 20.0 | W1 | 90 | 5.0 |
| 13 | 75.0 | 25.0 | — | D5 | 10.0 | E9 | 0.5 | W1 | 90 | 5.0 |
| 14 | 75.0 | 25.0 | — | D6 | 1.0 | E9 | 0.5 | W1 | 90 | 5.0 |
| 15 | 75.0 | 25.0 | — | D7 | 20.0 | E10 | 20.0 | W1 | 90 | 5.0 |
| 16 | 75.0 | 25.0 | — | D8 | 40.0 | E10 | 20.0 | W1 | 90 | 5.0 |
| 17 | — | — | 100.0 | D8 | 40.0 | E10 | 20.0 | W1 | 90 | 5.0 |
| 18 | — | — | 100.0 | D8 | 40.0 | E10 | 20.0 | W1 | 110 | 5.0 |
| 19 | — | — | 100.0 | D8 | 40.0 | E10 | 20.0 | W2 | 90 | 5.0 |
| 20 | 75.0 | 25.0 | — | D9 | 4.5 | E1 | 7.5 | W1 | 90 | 5.0 |
| 21 | 75.0 | 25.0 | — | D1 | 0.1 | E1 | 7.5 | W1 | 90 | 5.0 |
| 22 | 3.3 | 1.2 | — | D1 | 100.0 | E11 | 20.0 | W1 | 70 | 5.0 |

| | resin particle (toner) | | | production method | | resin layer | |
|---|---|---|---|---|---|---|---|
| toner No. | average circularity | D4 (μm) | O/C (%) | type | hot air current treatment | average layer thickness (μm) | coverage ratio (%) |
| 1 | 0.975 | 6.4 | 11.0 | P1 | yes | 0.4 | 100 |
| 2 | 0.967 | 6.4 | 9.0 | P1 | no | 0.5 | 92 |
| 3 | 0.967 | 6.4 | 12.0 | P1 | no | 0.5 | 92 |
| 4 | 0.968 | 6.4 | 11.0 | P1 | no | 0.5 | 92 |
| 5 | 0.968 | 6.4 | 10.0 | P2 | no | 0.5 | 92 |
| 6 | 0.968 | 6.4 | 8.0 | P2 | no | 0.3 | 92 |
| 7 | 0.968 | 6.4 | 10.0 | P2 | no | 0.3 | 92 |
| 8 | 0.968 | 6.4 | 5.0 | P2 | no | 0.3 | 92 |
| 9 | 0.968 | 6.4 | 13.0 | P2 | no | 0.6 | 93 |
| 10 | 0.957 | 6.2 | 14.0 | P2 | no | 0.6 | 94 |
| 11 | 0.959 | 6.8 | 13.0 | P2 | no | 0.7 | 93 |
| 12 | 0.968 | 6.4 | 14.0 | P2 | no | 0.3 | 91 |
| 13 | 0.968 | 6.4 | 13.0 | P2 | no | 0.7 | 94 |
| 14 | 0.969 | 6.4 | 13.0 | P2 | no | 0.1 | 92 |
| 15 | 0.967 | 6.4 | 15.0 | P2 | no | 1.0 | 96 |
| 16 | 0.961 | 6.6 | 21.0 | P2 | no | 1.0 | 98 |
| 17 | 0.963 | 6.3 | 24.0 | P2 | no | 1.0 | 98 |
| 18 | 0.966 | 6.4 | 22.0 | P2 | no | 1.0 | 98 |
| 19 | 0.965 | 6.5 | 23.0 | P2 | no | 1.0 | 98 |
| 20 | 0.973 | 6.4 | 7.0 | P1 | yes | 0.4 | 100 |
| 21 | 0.974 | 6.4 | 50.0 | P1 | yes | 0.01 | 85 |
| 22 | 0.944 | 5.7 | 80.0 | P2 | no | 0.5 | 92 |

In Table 3, for the wax type, W1 indicates a hydrocarbon wax and W2 indicates an ester wax; for the production method, P1 indicates melt-kneading method and P2 indicates emulsion aggregation method.

Magnetic Core Particle 1 Production Example

Step 1 (Weighing/Mixing Step):

| | |
|---|---|
| $Fe_2O_3$ | 62.7 parts |
| $MnCO_3$ | 29.5 parts |
| $Mg(OH)_2$ | 6.8 parts |
| $SrCO_3$ | 1.0 part |

The ferrite starting materials were weighed out so that these materials assumed the composition ratio given above. This was followed by pulverization and mixing for 5 hours using a dry vibrating mill using stainless steel beads having a diameter of ⅛-inch.

Step 2 (Pre-Firing Step):

The obtained pulverizate was converted into approximately 1 mm-square pellets using a roller compactor. After removal of the coarse powder using a vibrating screen having an aperture of 3 mm and subsequent removal of the fines using a vibrating screen having an aperture of 0.5 mm, the pellets were fired for 4 hours at a temperature of 1000° C. in burner-type firing furnace under a nitrogen atmosphere (oxygen concentration: 0.01 volume %) to produce a pre-fired ferrite. The composition of the resulting pre-fired ferrite was as follows.

$$(MnO)_a(MgO)_b(SrO)_c(Fe_2O_3)_d$$

In this formula, a=0.257, b=0.117, c=0.007, d 0.393

Step 3 (Pulverization Step):

The resulting pre-fired ferrite was pulverized to about 0.3 mm with a crusher followed by pulverization for 1 hour with a wet ball mill using zirconia beads with a diameter of ⅛-inch and with the addition of 30 parts water per 100 parts of the pre-fired ferrite. The obtained slurry was milled for 4 hours using a wet ball mill using alumina beads with a diameter of 1/16-inch to obtain a ferrite slurry (finely pulverized pre-fired ferrite).

Step 4 (Granulation Step):

1.0 part of an ammonium polycarboxylate as a dispersing agent and 2.0 parts of polyvinyl alcohol as a binder per 100 parts of the pre-fired ferrite were added to the ferrite slurry, followed by granulation with a spray dryer (manufacturer: Ohkawara Kakohki Co., Ltd.) into spherical particles. Particle size adjustment was carried out on the obtained particles, which were subsequently heated for 2 hours at 650° C. using a rotary kiln to remove the organic components, e.g., the dispersing agent and binder.

Step 5 (Firing Step):

In order to control the firing atmosphere, the temperature was raised over 2 hours from room temperature to a temperature of 1300° C. in an electric furnace under a nitrogen atmosphere (oxygen concentration: 1.00 volume %); firing was then carried out for 4 hours at a temperature of 1150° C. This was followed by cooling to a temperature of 60° C. over 4 hours; returning to the atmosphere from the nitrogen atmosphere; and removal at a temperature at or below 40° C.

Step 6 (Classification Step):

After the aggregated particles had been crushed, the weakly magnetic fraction was cut out by magnetic separation and the coarse particles were removed by sieving on a sieve with an aperture of 250 μm to obtain a magnetic core particle 1 having a 50% particle diameter on a volume basis (d50) of 37.0 μm.

<Preparation of Coating Resin 1>

| | |
|---|---|
| cyclohexyl methacrylate monomer | 26.8 mass % |
| methyl methacrylate monomer | 0.2 mass % |
| methyl methacrylate macromonomer (macromonomer having a weight-average molecular weight of 5000 and having the methacryloyl group at one terminal) | 8.4 mass % |
| toluene | 31.3 mass % |
| methyl ethyl ketone | 31.3 mass % |
| azobisisobutyronitrile | 2.0 mass % |

Among these materials, the cyclohexyl methacrylate monomer, methyl methacrylate monomer, methyl methacrylate macromonomer, toluene, and methyl ethyl ketone were introduced into a four-neck separable flask fitted with a reflux condenser, thermometer, nitrogen introduction line, and stirring apparatus, and nitrogen gas was introduced to substitute the interior of the system with the nitrogen gas. This was followed by heating to 80° C. and addition of the azobisisobutyronitrile and polymerization for 5 hours under reflux. The copolymer was precipitated by pouring hexane into the obtained reaction product and the precipitate was separated by filtration and then vacuum dried to obtain a coating resin 1.

30 parts of the coating resin 1 were then dissolved in 40 parts of toluene and 30 parts of methyl ethyl ketone to obtain a polymer solution 1 (30 mass % solids concentration).

<Preparation of Coating Resin Solution 1>

| | |
|---|---|
| polymer solution 1 (30% resin solids concentration) | 33.3 mass % |
| toluene | 66.4 mass % |
| carbon black (primary particle diameter = 25 nm, specific surface area by nitrogen adsorption = 94 $m^2/g$, DBP oil absorption = 75 mL/100 g) | 0.3 mass % |

were dispersed for 1 hour using a paint shaker and zirconia beads having a diameter of 0.5 mm. The obtained dispersion was filtered on a 5.0-μm membrane filter to obtain a coating resin solution 1.

Magnetic Carrier 1 Production Example (Resin Coating Step):

The magnetic core particle 1 and the coating resin solution 1 were introduced into a vacuum-degassed kneader being maintained at normal temperature (the amount of introduction for the coating resin solution 1 was an amount that provided 2.5 parts as the resin component per 100 parts of the magnetic core particle 1). After introduction, stirring was performed for 15 minutes at a rotation rate of 30 rpm and, after at least a certain amount (80%) of the solvent had been evaporated, the temperature was raised to 80° C. while mixing under reduced pressure and the toluene was distilled off over 2 hours followed by cooling. The obtained magnetic carrier, after fractionation and separation of the weakly magnetic product by magnetic selection and passage through a screen with an aperture of 70 μm, was classified using an air classifier to obtain a magnetic carrier 1 having a 50% particle diameter on a volume basis (d50) of 38.2

Two-Component Developer 1 Production Example 8.0 parts of toner 1 was added to 92.0 parts of magnetic carrier 1 and mixing was performed using a V-mixer (Model V-10, TOKUJU CORPORATION) at 0.5 $s^{-1}$ for a rotation time of 5 minutes to obtain a two-component developer 1.

Two-Component Developers 2 to 22 Production Example

Two-component developers 2 to 22 were obtained proceeding as in the Two-Component Developer 1 Production Example, but changing toner 1 to toners 2 to 22, respectively.

Example 1

Evaluations were carried out using the two-component developer 1.

An imageRUNNER ADVANCE C9075 PRO digital multifunction machine from Canon Inc. was used as the image-forming apparatus; it was modified to enable the fixation temperature and the process speed to be freely set. The two-component developer 1 was introduced into the developing device at the cyan position of this modified apparatus and the following evaluations were performed with adjustment of the direct-current voltage $V_{DC}$ at the developer bearing member, the charging voltage $V_D$ at the electrostatic latent image-bearing member, and the laser power so as to provide the desired toner laid-on level on the electrostatic latent image-bearing member or paper. The results are given in Table 4.

<Evaluation 1: Charging Performance (Charge Retention Ratio)>

The triboelectric charge quantity for the toner and the toner laid-on level were calculated by suction collection of the toner on the electrostatic latent image-bearing member using a metal cylindrical tube and a cylindrical filter.

Figure 2:
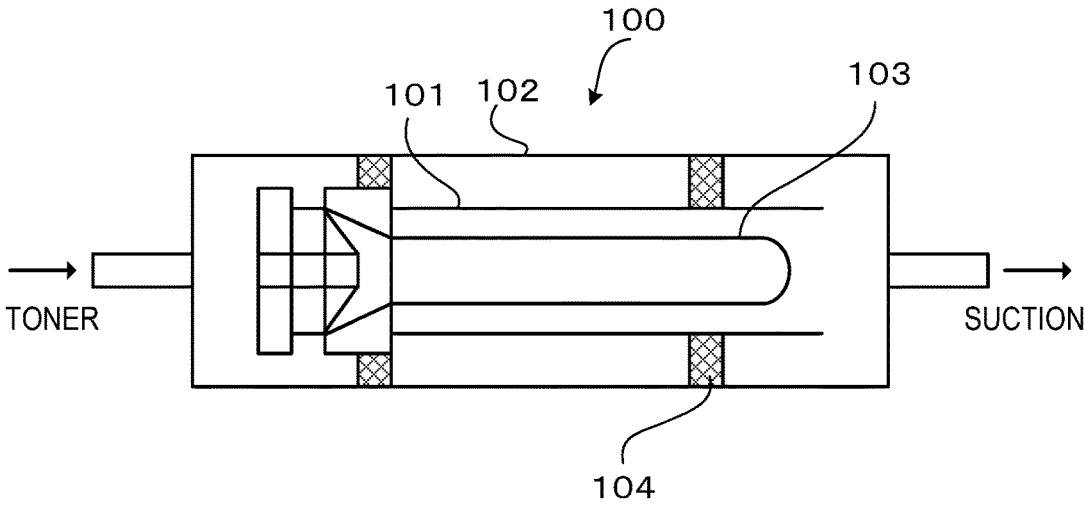
FIG. 2 is a schematic diagram of a Faraday cage.

Specifically, the triboelectric charge quantity and the toner laid-on level for the toner on the electrostatic latent image-bearing member were measured using a Faraday cage as shown in FIG. 2.

The toner on the electrostatic latent image-bearing member is suctioned using a Faraday cage 100, which is provided with inner and outer double cylinders 101 and 102 comprising coaxially disposed metal cylinders having different shaft diameters and with a filter 103 for further intake of the toner to within the inner cylinder 101.

The inner cylinder 101 is insulated from the outer cylinder 102 by an insulating member 104 in the Faraday cage 100, and, when toner is delivered to within the filter, electrostatic induction is produced by the charge quantity Q of the toner. When a charged body carrying a charge quantity Q is introduced into this inner cylinder, due to electrostatic induction this is the same as the presence of a metal cylinder carrying charge quantity Q. This induced charge quantity was measured with an electrometer (Keithley 6517A, Keithley Instruments, Inc.), and the triboelectric charge quantity Q (mC) divided by the mass M (kg) of the toner in the inner cylinder, or Q/M, was taken to be the triboelectric charge quantity for the toner.

In addition, the toner laid-on level per unit area was obtained by measuring the suctioned area S and dividing the toner mass M by the suctioned area S ($cm^2$).

The toner was measured by stopping the rotation of the electrostatic latent image-bearing member prior to transfer, to the intermediate transfer member, of the toner layer formed on the electrostatic latent image-bearing member and directly air-suctioning the toner image on the electrostatic latent image-bearing member.

toner laid-on level ($mg/cm^2$)=M/S toner triboelectric charge quantity (mC/kg)=Q/M The aforementioned image-forming apparatus was adjusted to have a toner laid-on level on the electrostatic latent image-bearing member in a high-temperature, high-humidity environment (32.5° C., 80% RH) of 0.35 $mg/cm^2$, and suction collection was performed using the aforementioned metal cylindrical tube and cylindrical filter. At this time, the charge quantity Q that went into the metal cylindrical tube and was accumulated in a capacitor and the collected toner mass M were measured and the charge quantity per unit mass Q/M (mC/kg) was calculated and used for the charge quantity per unit mass Q/M (mC/kg) on the electrostatic latent image-bearing member (initial evaluation).

After this evaluation (initial evaluation) had been performed, the developing unit was removed from the machine and was held for 48 hours in a high-temperature, high-humidity environment (32.5° C., 80% RH). After this holding, the developing unit was re-mounted in the machine and the charge quantity per unit mass Q/M on the electrostatic latent image-bearing member was measured at the same direct-current voltage $V_{DC}$ as in the initial evaluation (post-holding evaluation).

Using the Q/M per unit mass on the electrostatic latent image-bearing member in the initial evaluation for 100%, the retention ratio for the charge quantity per unit mass Q/M on the electrostatic latent image-bearing member after the 48-hour holding period (post-holding evaluation) was calculated (post-holding evaluation/initial evaluation×100) and was scored using the following criteria.

The evaluation criteria were as follows.

A: the retention ratio is at least 90%: very good

B: the retention ratio is at least 80% and less than 90%: good

C: the retention ratio is at least 70% and less than 80%: fair

D: the retention ratio is at least 60% and less than 70%: acceptable level for the present invention E: the retention ratio is less than 60%: unacceptable level for the present invention <Evaluation 2: Durability>

In this evaluation, the durability of the toner was evaluated by observing the transferability after use in a durability test.

CS-680 (68.0 $g/m^2$) (marketed by Canon Marketing Japan Inc.) was used for the paper in the evaluation.

A strip chart with FFh output at an image percentage of 0.1% was used in this evaluation, and 10,000 prints were output on A4 paper. FFh refers to a value that is a hexadecimal representation of 256 gradations, where 00h is the 1st gradation (white background) of the 256 gradations and FFh is the 256th gradation (solid area) of the 256 gradations.

To evaluate the transferability, toner at 0.35 $mg/cm^2$ was developed onto the photosensitive drum and the operation of the main unit was shutdown during the transfer step. Tape was applied to the untransferred toner remaining on the photosensitive drum and its density was measured.

The optimal value in accordance with the toner charge quantity was used for the transfer current setting. The density measurement used an X-Rite color reflection densitometer (500 series, X-Rite Inc.).

The evaluation criteria are as follows.

(The Toner Rank Prior to Use in the Durability Test was a for all of Toners 1 to 22.)

A: less than 0.08: very good

B: at least 0.08 and less than 0.11: good

C: at least 0.11 and less than 0.13: fair

D at least 0.13 and less than 0.16: acceptable level for the present invention

E: at least 0.16: unacceptable level for the present invention

<Evaluation 3: Hot Offset Resistance> paper: CS-680 (68.0 $g/m^2$)

(marketed by Canon Marketing Japan Inc.)

toner laid-on level: 0.08 $mg/cm^2$ evaluated image: 10 $cm^2$ image positioned at both ends of the aforementioned A4 paper fixability test environment: normal-temperature, low-humidity environment: temperature=23° C./humidity=5% RH ("N/L" in the following)

After production of the aforementioned unfixed image, the process speed was set to 450 mm/sec and the hot offset resistance was evaluated while incrementing the fixation temperature in 5° C. steps in sequence from 150° C.

With regard to the procedure, 10 plain postcards were first fed through in center position on the fixing belt followed by feed of the aforementioned unfixed image. The fogging value was used as the evaluation index for the hot offset.

The average reflectance Dr (%) of the evaluation paper prior to image output and the reflectance Ds (%) of the white background after the fixability test were measured using a reflectometer (Model TC-6DS Reflectometer, Tokyo Denshoku Co., Ltd.), and the fogging was calculated using the following formula.

$$\text{fogging}(\%)=Dr(\%)-Ds(\%)$$

In this example, the toner particle surface is coated with a cyclic polyolefin resin, which exhibits a poor fixability to paper. However, differences existed in the affinity with the wax contained in the toner particle depending on the structure of the cyclic polyolefin resin, and differences in the hot offset resistance were produced depending on the ease of mixing during fixing between the wax and the cyclic polyolefin resin.

In addition, effects on the hot offset resistance were produced due to the generation of differences in the wax dispersibility depending on the method of toner particle production.

The evaluation criteria were as follows.

A: less than 0.4%: very good

B: at least 0.4% and less than 0.6%: good

C: at least 0.6% and less than 0.8%: fair

D at least 0.8% and less than 1.0%: acceptable level for the present invention

E: at least 1.0%: unacceptable level for the present invention

<Evaluation 4: Low-Temperature Fixability> paper: CS-680 (68.0 $g/m^2$)

(marketed by Canon Marketing Japan Inc.)

toner laid-on level on the paper: 1.20 $mg/cm^2$ evaluated image: 10 $cm^2$ image positioned in the center of the aforementioned A4 paper fixability test environment: low-temperature, low-humidity environment: temperature=15° C./humidity=10% RH ("L/L" in the following)

After the direct-current voltage $V_{DC}$ at the developer bearing member, the charging voltage $V_D$ at the electrostatic latent image-bearing member, and the laser power had been adjusted so as to provide the aforementioned toner laid-on level on the paper, the process speed was set to 450 mm/sec and the fixation temperature was set to 130° C. and the low-temperature fixability was then evaluated.

The value of the image density reduction percentage was used as the evaluation index for the low-temperature fixability.

To obtain the image density reduction percentage, the image density in the center is first measured using an X-Rite color reflection densitometer (500 series, X-Rite Inc.). Then, the fixed image in the area where the image density was measured is rubbed (5 times back-and-forth) with lens-cleaning paper under a load of 4.9 kPa (50 g/$cm^2$), and the image density is measured again. The reduction (%) in the image density pre-versus-post-rubbing was thus measured.

The evaluation criteria were as follows.

A: the density reduction is less than 1.0%: very good

B: the density reduction is at least 1.0% and less than 4.0%: good

C: the density reduction is at least 4.0% and less than 7.0%: fair

D: the density reduction is at least 7.0% and less than 10.0%: acceptable level for the present invention E: the density reduction is at least 10.0%: unacceptable level for the present invention Very good results were obtained in Example 1 for all of the charging performance, durability, offset resistance, and low-temperature fixability.

Examples 2 to 19 and Comparative Examples 1 to 3

The same evaluations as in Example 1 were performed using the two-component developers 2 to 22 given in Table 4. The results of the evaluations are given in Table 4.

In Example 2, in comparison to Example 1, because the heat treatment was not performed, the wax did not migrate to the neighborhood of the toner particle surface and some reduction in the hot offset resistance occurred.

In Examples 3 and 4, in comparison to Example 1, because the heat treatment was not performed, the wax did not migrate to the neighborhood of the toner particle surface and some reduction in the hot offset resistance occurred.

In Examples 5, 6, and 7, in comparison to Example 4, because the emulsion aggregation method was used as the method of toner production, the wax dispersity was reduced and the hot offset resistance was reduced.

In Example 8, in comparison to Example 7, due to the smaller content of the crystalline polyester, there was then less plasticizing effect by the crystalline polyester and the low-temperature fixability was reduced.

In Example 9, in comparison to Example 7, the crystalline polyester content was larger, but, due to the change in the number of carbons in the aliphatic diol constituting the crystalline polyester to 12 and the change in the number of carbons in the aliphatic dicarboxylic acid to 10, the plasticizing effect by the crystalline polyester was somewhat smaller and the low-temperature fixability was reduced.

In Example 10, in comparison to Example 9, due to the change in the number of carbons in the aliphatic diol constituting the crystalline polyester to 6 and the change in the number of carbons in the aliphatic dicarboxylic acid to 16 and also due to the increase in the content, the crystalline polyester precipitated to a slight degree on the toner particle surface and the charging performance was reduced.

In Examples 11 and 12, in comparison to Example 10, due to the change in the type of crystalline polyester and also due to the reduction in the content, the plasticizing effect by the crystalline polyester was smaller and the low-temperature fixability was then reduced.

In Example 13, in comparison to Example 12, the number of carbons in the aliphatic diol constituting the crystalline polyester was changed to 4 and the number of carbons in the aliphatic dicarboxylic acid was changed to 4 and the content was also reduced. In addition, because the cyclic olefin constituting the polyolefin resin was changed to cyclohexane, surface migration by the crystalline polyester proceeded to a small degree and the durability was reduced.

In Example 14, in comparison to Example 12, the number of carbons in the aliphatic diol constituting the crystalline polyester was changed to 4 and the number of carbons in the aliphatic dicarboxylic acid was changed to 4 and the content was also reduced. In addition, because the cyclic olefin constituting the polyolefin resin was changed to cyclopentane and the α-olefin was changed to 1-dodecene, migration by the crystalline polyester to the toner particle surface proceeded to a small degree and the durability was reduced.

In Example 15, in comparison to Example 14, due to the use of only cyclobutene for the monomer constituting the polyolefin resin, migration by the crystalline polyester to the toner particle surface progressed and the charging performance was reduced. In addition, because the polyolefin resin contained neither ethylene nor α-olefin, the occurrence of outmigration by the wax during fixing was impeded and the hot offset resistance was also reduced. In Example 16, in comparison to Example 15, due to the use of only cyclopropene for the monomer constituting the polyolefin resin, migration by the crystalline polyester to the toner particle surface progressed and the charging performance and the durability were reduced.

In Example 17, in comparison to Example 16, the durability was reduced due to the use of a styrene-acrylic resin for the amorphous resin.

In Examples 18 and 19, in comparison to Example 17, the low-temperature fixability was reduced due to the change in the type of wax.

In Comparative Example 1, the monomer constituting the polyolefin resin is ethylene. That is, the toner particle surface was coated by a chain polyolefin resin. As a result, the charging performance and durability assumed levels not acceptable for the present invention.

In Comparative Example 2, a toner is used in which a cyclic polyolefin coat layer was not formed. As a result, the charging performance assumed a result at a level not acceptable for the present invention.

In Comparative Example 3, a cyclic polyolefin resin was used as the main binder resin for the toner and the toner particle surface was coated with an amorphous polyester resin. In addition, the toner was produced by the emulsion aggregation method. As a result, the durability and charging performance assumed results at a level not acceptable for the present invention.

TABLE 4

| | two-component developer | | evaluation 1 charging performance | | | | evaluation 2 durability | | evaluation 3 hot offset resistance | | evaluation 4 low-temperature fixability density | |
|---|---|---|---|---|---|---|---|---|---|---|---|---|
| | | | initial | post-holding | retention | | | | | | | |
| | No. | toner No. | Q/M [mC/kg] | Q/M [mC/kg] | ratio (%) | eval. | density (%) | eval. | fogging (%) | eval. | reduction (%) | eval. |
| example 1 | 1 | 1 | 38.6 | 36.8 | 95.4 | A | 0.01 | A | 0.2 | A | 0.2 | A |
| example 2 | 2 | 2 | 36.4 | 34.3 | 94.1 | A | 0.05 | A | 0.4 | B | 0.3 | A |
| example 3 | 3 | 3 | 34.2 | 32.2 | 94.2 | A | 0.04 | A | 0.5 | B | 0.4 | A |
| example 4 | 4 | 4 | 36.1 | 33.7 | 93.3 | A | 0.03 | A | 0.5 | B | 0.5 | A |
| example 5 | 5 | 5 | 35.7 | 33.4 | 93.5 | A | 0.05 | A | 0.6 | C | 0.4 | A |
| example 6 | 6 | 6 | 37.9 | 35.4 | 93.5 | A | 0.04 | A | 0.6 | C | 0.9 | A |
| example 7 | 7 | 7 | 37.7 | 34.0 | 90.1 | A | 0.07 | A | 0.7 | C | 0.5 | A |
| example 8 | 8 | 8 | 37.1 | 34.9 | 94.2 | A | 0.02 | A | 0.7 | C | 2.0 | B |
| example 9 | 9 | 9 | 35.1 | 29.9 | 85.2 | B | 0.01 | A | 0.7 | C | 3.0 | B |
| example 10 | 10 | 10 | 33.5 | 29.7 | 88.6 | B | 0.03 | A | 0.6 | C | 2.0 | B |
| example 11 | 11 | 11 | 33.9 | 29.3 | 86.4 | B | 0.02 | A | 0.6 | C | 4.5 | C |
| example 12 | 12 | 12 | 38.1 | 31.7 | 83.2 | B | 0.04 | A | 0.6 | C | 5.0 | C |
| example 13 | 13 | 13 | 37.9 | 32.0 | 84.5 | B | 0.08 | B | 0.6 | C | 6.0 | C |
| example 14 | 14 | 14 | 36.3 | 31.4 | 86.5 | B | 0.09 | B | 0.6 | C | 5.1 | C |
| example 15 | 15 | 15 | 38.0 | 28.2 | 74.3 | C | 0.10 | B | 0.8 | D | 4.8 | C |
| example 16 | 16 | 16 | 35.9 | 28.2 | 78.6 | C | 0.12 | C | 0.8 | D | 6.5 | C |
| example 17 | 17 | 17 | 35.6 | 27.4 | 77.1 | C | 0.13 | D | 0.8 | D | 4.3 | C |
| example 18 | 18 | 18 | 35.8 | 27.3 | 76.3 | C | 0.14 | D | 0.8 | D | 6.1 | C |
| example 19 | 19 | 19 | 35.8 | 27.0 | 75.4 | C | 0.15 | D | 0.8 | D | 7.0 | D |
| comparative example 1 | 20 | 20 | 31.5 | 15.6 | 49.5 | E | 0.17 | E | 0.9 | D | 9.5 | D |
| comparative example 2 | 21 | 21 | 31.2 | 17.5 | 56.0 | E | 0.15 | D | 0.9 | D | 9.3 | D |
| comparative example 3 | 22 | 22 | 30.7 | 16.1 | 52.5 | E | 0.17 | E | 0.9 | D | 9.4 | D |

The present invention can provide a toner that exhibits an excellent durability in long-term use, a stable charging performance after holding in a high-temperature, high-humidity environment, and an excellent low-temperature fixability.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application is a divisional of application Ser. No. 15/498,966 filed Apr. 27, 2017, which in turn claims the benefit of Japanese Patent Application No. 2016-092528, filed, May 2, 2016, which are hereby incorporated by reference herein in their entirety.

What is claimed is:

1. A process for producing a toner containing a toner particle, comprising the steps of:

obtaining a resin base particle containing an amorphous resin, a crystalline polyester, and a wax, adsorbing a cyclic polyolefin resin particle to the resin base particle surface, and melting the cyclic polyolefin resin particle by contacting hot air current with the resin base particle adsorbing the cyclic polyolefin resin particle, thereby forming a coat layer containing a cyclic polyolefin resin on the resin base particle surface, thereby obtaining the toner particle, wherein the toner particle contains an amorphous resin, a crystalline polyester, and a wax, the toner particle comprises said coat layer and an inner region which is coated by the coat layer, the coat layer is present at the surface of the toner particle, and contains a cyclic polyolefin resin, and the inner region contains the crystalline polyester.

2. The process according to claim 1, wherein a temperature of the hot air current is 100 to 300° C.

3. The process according to claim 1, wherein a temperature of the hot air current is 130 to 170° C.

4. The process according to claim 1, wherein a glass transition temperature of the cyclic polyolefin resin is 65 to 105° C.

5. The process according to claim 1, wherein a glass transition temperature of the cyclic polyolefin resin is 75 to 85° C.

6. The process according to claim 1, wherein an average layer thickness of the coat layer at the toner particle surface is 0.1 to 1.0 μm.

7. The process according to claim 1, wherein a coverage ratio by the coat layer is at least 90% with respect to the toner particle.

* * * * *